US006026529A

United States Patent [19]

Caruso

[11] Patent Number: 6,026,529

[45] **Date of Patent: *Feb. 22, 2000**

[54] AUTOMATED ROTARY MOPPING, WAXING, AND LIGHT SWEEPING SYSTEMS

[76] Inventor: Steven Jerome Caruso, 862 Pine Hill Dr., Antioch, Ill. 60002

[ * ] Notice: This patent is subject to a terminal disclaimer.

[21] Appl. No.: 08/912,714

[22] Filed: Aug. 18, 1997

Related U.S. Application Data

[63] Continuation-in-part of application No. 08/486,717, Jun. 7, 1995, Pat. No. 5,657,503.

[51] Int. Cl.[7] ..... A47L 11/03

[52] U.S. Cl. ..... 15/98; 15/97.1

[58] Field of Search ..... 15/97.1, 98, 103

[56] References Cited

U.S. PATENT DOCUMENTS

| | | |
|---|---|---|
| 466,681 | 1/1892 | Hawks . |
| 643,469 | 2/1900 | Clise . |
| 1,010,097 | 11/1911 | Vidak . |
| 1,520,769 | 12/1924 | Peterson . |
| 2,706,863 | 4/1955 | Jones . |
| 2,857,606 | 10/1958 | Sperka . |
| 2,976,112 | 3/1961 | Yonkers et al. . |
| 3,067,444 | 12/1962 | Dickson et al. . |
| 3,127,628 | 4/1964 | Klumb . |
| 3,346,896 | 10/1967 | Arones . |
| 3,533,119 | 10/1970 | Dokos . |
| 3,533,120 | 10/1970 | Mercado . |
| 3,599,272 | 8/1971 | Merrick . |
| 3,630,369 | 12/1971 | Nichols . |
| 3,638,270 | 2/1972 | Schlegel, Jr. et al. . |
| 3,651,529 | 3/1972 | Popeil et al. . |
| 3,656,200 | 4/1972 | Riley, Jr. . |
| 3,789,449 | 2/1974 | MacFarland et al. . |
| 3,795,933 | 3/1974 | Seufert . |
| 3,822,433 | 7/1974 | Krekler . |
| 3,845,518 | 11/1974 | Popeil et al. . |
| 4,173,054 | 11/1979 | Ando . |
| 4,293,971 | 10/1981 | Block . |
| 4,506,405 | 3/1985 | Block . |
| 4,542,549 | 9/1985 | Keller . |
| 4,577,364 | 3/1986 | Demetriads . |
| 4,642,832 | 2/1987 | Trisolini . |
| 4,781,556 | 11/1988 | Paul . |
| 4,833,752 | 5/1989 | Merrick . |
| 4,854,005 | 8/1989 | Wiese et al. . |
| 4,865,782 | 9/1989 | Paul . |
| 4,875,246 | 10/1989 | MacGregor . |
| 4,926,515 | 5/1990 | Lynn et al. . |
| 4,989,293 | 2/1991 | Bashyam . |
| 5,012,542 | 5/1991 | Lynn . |
| 5,040,339 | 8/1991 | Warner . |
| 5,067,199 | 11/1991 | Alazet ..... 15/320 |
| 5,239,720 | 8/1993 | Wood et al. . |
| 5,287,581 | 2/1994 | Lo . |
| 5,555,587 | 9/1996 | Guha . |
| 5,657,503 | 8/1997 | Caruso . |
| 5,657,504 | 8/1997 | Khoury ..... 15/98 |

*Primary Examiner*—Terrence R. Till
*Attorney, Agent, or Firm*—McAndrews, Held & Malloy, Ltd.

[57] ABSTRACT

A device for cleaning floors or other hard surfaces is disclosed. The device includes a moving absorbent surface (such as a roller cover), a shear member, and optionally a pump. The absorbent surface contacts a hard surface as it is being cleaned. The absorbent surface is adapted to scrub the hard surface and remove a waste fluid from the hard surface. The shear member may take various forms, such as a fixed blade or a squeeze roller. The shear member selectively contacts the absorbent outer surface of the roller and channels away a fluid previously absorbed in the absorbent outer surface of the roller. The pump conveys away a fluid removed from the roller by the shear member. The device may be used much like a mop for cleaning floors, and is particularly suited for residential use by consumers.

2 Claims, 18 Drawing Sheets

270
42
58
179
151
180
32
178

268
266
270
260
258
264
262
240
SERVO
256
177
254
252
246
248
250
272
244
274
242
128
136
MAIN
ROLLER
MOTOR
134
301
299
276
300
288
292
296
298
278
284
280
294
282
286
290

342
338
346
354
340
352
348
350
344

AUTOMATED ROTARY MOPPING, WAXING, AND LIGHT SWEEPING SYSTEMS

CROSS-REFERENCE TO RELATED APPLICATIONS

This application is a continuation-in-part of U.S. Ser. No. 08/486,717, filed Jun. 7, 1995, now U.S. Pat. No. 5,657,503. That entire application is incorporated here by reference.

FIELD OF THE INVENTION

The present invention relates generally to a cleaning implement having a moving absorbent surface for picking up liquid, and more particularly to such an implement which can be manipulated much like a conventional mop to clean hard surfaces, particularly uncarpeted flooring or other surfaces.

BACKGROUND OF THE INVENTION

In the art of bare (i.e. uncarpeted) floor care, a "scrubber" that employs one or more spinning discs, surfaced with bristles and/or scouring materials, is known. It is also known that a vacuuming system may be employed to pick up soiled fluids following scrubbing. These systems create an atmospheric vacuum remote from the site of pickup. It is also known that various methods of wringing a mop or the like have been employed. For example see U.S. Pat. Nos. 3,822,433 and 4,642,832.

A spinning cylinder that is sheared by a rigid wiper to remove water has been suggested. See U.S. Pat. No. 3,789,449.

SUMMARY OF THE INVENTION

The present invention is intended to provide a relatively simple hard surface care system, which preferably is inexpensive and light enough in weight to address the needs of residential and commercial users.

The invention is a device for cleaning floors or other hard surfaces. In one aspect of the invention, the device includes a moving absorbent surface, a shear member, and a drive for the moving absorbent surface.

As defined herein, a "moving" surface is defined as a surface that normally moves when the present device is in use. An "endless moving surface" is defined as a moving surface having one or more elements that normally periodically traverses an established closed path and thus regularly returns to any point on the path without stopping. A reciprocating surface is a moving surface that moves back and forth along a straight or curved path, usually (but not necessarily) stopping momentarily at each end of its travel. "Absorbent surface" has its usual meaning, and need not be a continuous absorbent surface. In other words, the present moving absorbent surface, even if "endless," can be one or more isolated elements interrupted by scrubbing bars, non-absorbent regions, or the like within the scope of the present invention.

The moving absorbent surface can have several different forms. One such torn is a rigid or flexible cylindrical roller having an absorbent outer surface and rotatable about its axis. Another such form is a belt defining an absorbent outer surface and carried on one or more rollers or other structure. Yet another such font is a flexible, rotating disk adapted to be disposed at an angle to a hard surface with a portion of the disk on one side of its center of rotation pressed into contact with the surface and thus bent out of the plane of the disk (much as a flexible sanding disk is used). Another form of moving absorbent surfaces contemplated herein is a reciprocating surface, which may reciprocate in a straight line or along a curved path (or both).

Each of these forms of a moving absorbent surface has a first portion adapted to be normally disposed substantially in contact with a hard surface to define an area of contact and a second portion adapted to be normally disposed out of contact with the hard surface. Particular elements of the absorbent surface move through the first portion and the second portion alternately, thus periodically coming into contact and leaving contact with the surface to be cleaned.

The shear member may take various forms, such as a blade or a squeeze roller. The shear member is located near the absorbent outer surface of the roller and runs generally parallel to the roller (although it may be slightly skewed to promote drainage, as is further discussed below). The shear member has a fluid transporting surface having first and second portions. The shear member can at least substantially contact the absorbent surface to channel away a previously absorbed fluid to the second portion of the fluid transporting surface.

The shear member optionally can have a second position at least substantially clear of the absorbent outer surface. A mechanism can be provided for moving at least one of the shear member and the absorbent surface relative to the other, thus moving the movable shear member between its first and second positions.

Several advantages are realized if the operator is able to disengage the shear member from the roller. First, cleaning fluid can be used more efficiently by not engaging the shear member until the. fluid is too soiled to further clean the hard surface being cleaned. Second, roller wear and power consumption are reduced while the shear member is disengaged. Reduced power consumption is particularly important if the implement is battery-driven. Third, the operator has more control over the cleaning process if he or she is able to operate the implement with the shear member selectively engaged or disengaged.

A mechanism is provided for moving the absorbent surface relative to the hard surface at the area of contact as the device is being used. This arrangement creates a scrubbing action between the absorbent outer surface and the hard surface at the area of contact.

Another aspect of the invention is a hard surface cleaning device including a support, an absorbent surface, a shear, member, and a peristaltic pump. The support may be a housing, a frame, or other suitable structure for supporting the other elements of the device, The absorbent surface has been described above. The shear member at least substantially contacts the second portion of the absorbent surface for removing fluid absorbed in the absorbent surface. The shear member is not necessarily movable as described above, though it may be movable. The peristaltic pump is provided for transporting away the fluid removed by the shear member. The pump optionally may include a stator and a rotor, one driven in common with the absorbent surface and the other supported by the support, so the pump operates when the absorbent surface is moving.

BRIEF DESCRIPTION OF DRAWINGS

Referring now to the figures.

The following reference characters are used in the drawings to refer to the parts of the present invention. Like reference characters indicate like or corresponding parts in the respective views.

Figure 1:
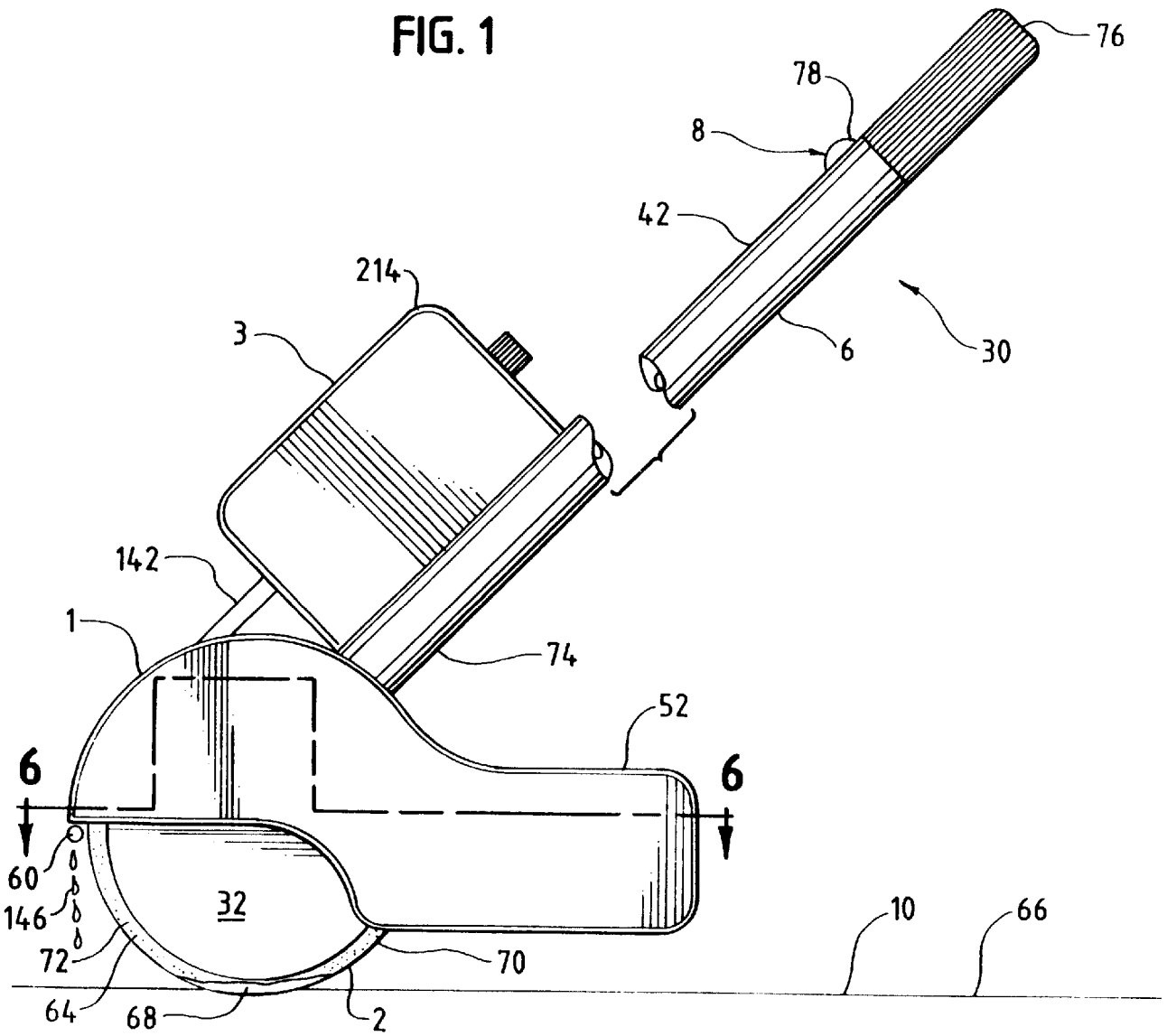
FIG. 1 is a schematic side elevational view, with parts broken away to show underlying structure, of one embodiment of my hard surface care implement.

30 implement for cleaning hard surfaces
32 roller (of 30)
34 shear member
36 mechanism for shifting 34
38 pump
40 conduit (outlet from 38) (pump outlet)
42 handle
44 reservoir
46 waste fluid chamber
48 fresh fluid chamber
52 housing
54 drive mechanism
56 staging area
58 drive control
60 fresh fluid delivery outlet
62 axis of rotation (of 32)
64 resilient outer surface (of 32)
66 hard surface
68 portion of 64 contacting 66
70 portion of 64 preceding 68
72 portion of 64 following 68
74 proximal end (of 42)
76 distal end (of 42)
78 drive control
80 fluid transporting surface
82 first portion (of 80)
84 second portion (of 80)
86 waste fluid
88 conduit
90 outlet of 56
92 outlet of 88/inlet of 38
94 sump (of 96)
96 tube (of 38)
98 side wall (of 52)
100 roller (of 38)
102 roller (of 38)
104 stub shaft (for 100)
106 stub shaft (for 102)
108 full-length shaft (for 32)
110 end wall (of 32)
112 conduit (from 40)
114 outlet (of 112)
116 shaft
118 crank portion (of 116)
120 end of 116
122 end of 116
124 electric conduit
126 electric conduit
128 motor
130 bracket
132 interior wall (of 32)
134 output shaft (of 128)
136 spur gear
138 ring gear
140 valve
142 conduit
144 inlet

146 stream (of cleaning fluid)
152 housing (FIG. 7)
156 staging area (FIG. 11)
158 shear member (FIG. 11)
160 pivot pin (FIG. 11)
162 link (FIG. 11)
164 pivot (FIG. 11)
166 second end (of 162)
168 pin (of 162)
170 crank
172 axis (of 170)
174 pivot
176 tab
177 servo motor
178 end wall (of 152)
179 pivoting cover
180 pivot pin
181 spring
182 outer sleeve
184 key
185 keyway
186 recess (in 32)
187 boss (of 179)
188 cover bias spring
190 outlet
192 poppet
194 guide tube
196 rocker arm
198 pivot (of 196)
200 other end (of 196)
202 spring
204 valve opening means
206 tank (of 48)
222 sub-housing
224 output shaft (of 220)
226 shear blade linkage drive shaft
228 spur gear
230 reduction gear
232 reduction gear
234 reduction gear
236 output gear
240 positional tracer
242 conductor
244 conductor
246 terminal of 220 (terminal pair)
248 terminal of 220 (terminal pair)
250 conductor
252 conductor
254 conductor
256 conductor
258 conductive path
260 conductive path
262 conductive path
264 conductive path
266 armature
268 sliding contact
270 sliding contact
272 conductor
274 conductor
276 rocker switch
278 contact (of 276)
280 contact (of 276)
282 contact (of 276)
284 contact (of 276)
286 switch element
288 switch element
290 pivot (of 276)
292 rocker handle (of 276)
294 power lead
296 power lead
298 power supply
299 conductor
300 switch
301 conductor
338 third embodiment of implement
340 tank
342 distal end (of 338)
344 proximal end
346 handle
348 splash guard
350 tongue
352 channel
354 channel
356 tongue
358 waste fluid tank
360 inlet
362 roller shaft
370 roller (shear member)
372 bearing shaft
376 axis (sheared)
378 axis (horizontal)
380 one end (of 370)
382 other end (of 370)
384 waste water
386 waste water (dribble)
388 staging area
390 roller (FIGS. 23–25)
392 channel
394 channel
396 end cap
398 roller (FIGS. 26–28)
400 channel (of 398)
402 channel (of 398)
404 channel (of 398)
406 channel (of 398)
408 end cap (of 398)
410 roller (of FIGS. 29–31)
412 channel (of 410)
414 channel (of 410)
416 channel (of 410)
418 channel (of 410)
420 end cap (of 410)

DETAILED DESCRIPTION OF THE INVENTION

While the invention will be described in connection with several preferred embodiments, it will be understood that the invention is not limited to these embodiments. On the contrary, the invention includes all alternatives, modifications, and equivalents as may be included within the spirit and scope of the appended claims.

Referring first to FIGS. 1–6, one embodiment of the present invention is illustrated. This embodiment is referred to generally by the reference character 30 in FIGS. 1–6. The implement 30 includes a generally cylindrical roller 32 defining an endless moving absorbent surface, a shear member 34 (best seen in FIG. 3), and a pump generally indicated as 38 in FIGS. 5 and 6 for pumping fluid removed from the roller 32 by the shear member 34 in a manner which will be described in more detail below. Further features of the implement of FIGS. 1–6 include a handle 42, a fluid reservoir 44 which includes two isolated chambers (respectively, a waste fluid chamber 46 and a fresh fluid chamber 48), a housing 52, a drive mechanism generally indicated at 54 in FIG. 3, a staging area 56 (shown in FIG. 3), a drive control 58 (such as a multi-position switch, which may be used to start or stop the drive 54 as desired by the operator), and a fresh fluid delivery outlet 60.

Figure 5:
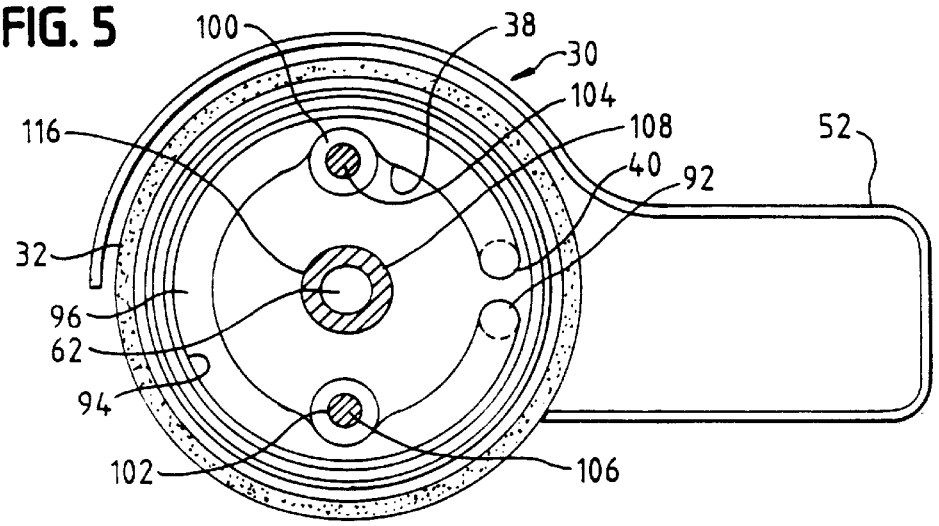
FIG. 5 is a sectional view taken along the line 5—5 of FIG. 2.
Figure 6:
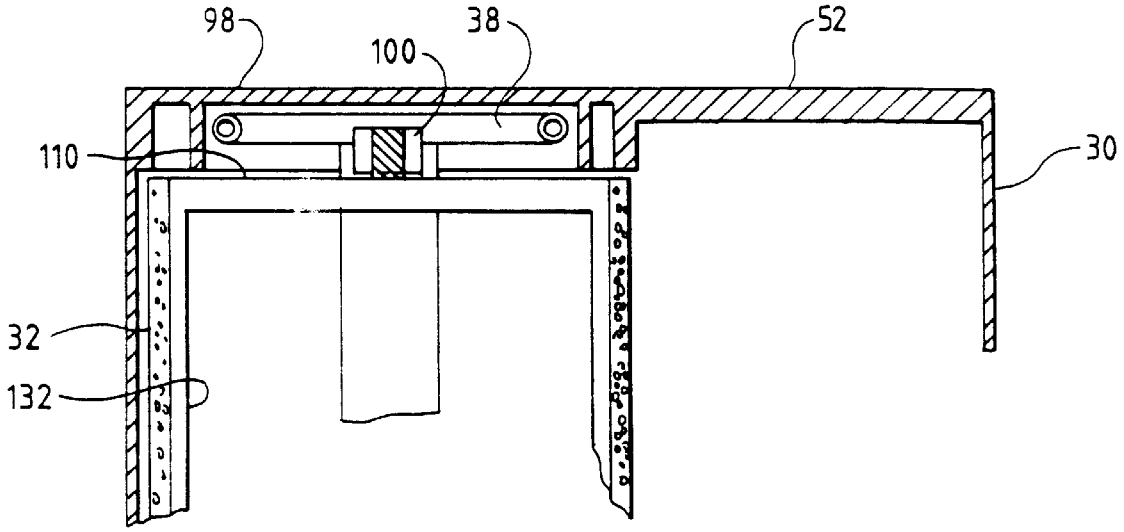
FIG. 6 is a portion of a section taken along line 6—6 of FIG. 1.

The roller 32 has an axis of rotation 62, as illustrated specifically in FIG. 5. The roller 32 has an absorbent, resilient outer surface or cover 64 which bears against a hard surface 66 best illustrated in FIG. 1. The cover 64 can have an axial groove or rib which engages a complementary rib or groove in the roller 32 to secure it in place. The cover 64 can then be slid axially onto or off of the roller 32 to clean, discard, or replace it.

FIG. 5 illustrate that the axis 62 is adapted to be normally disposed substantially parallel to the hard surface 66 when the implement 30 is in use. FIG. 1 also illustrates that the portion 68 of the resilient outer surface 64 which defines an area of contact with the hard surface 66 is compressed, while the portions such as 70 of the resilient outer surface 64 which are out of contact with the hard surface 66 at any given time are resiliently expanded to their normal dimensions.

Figure 3:
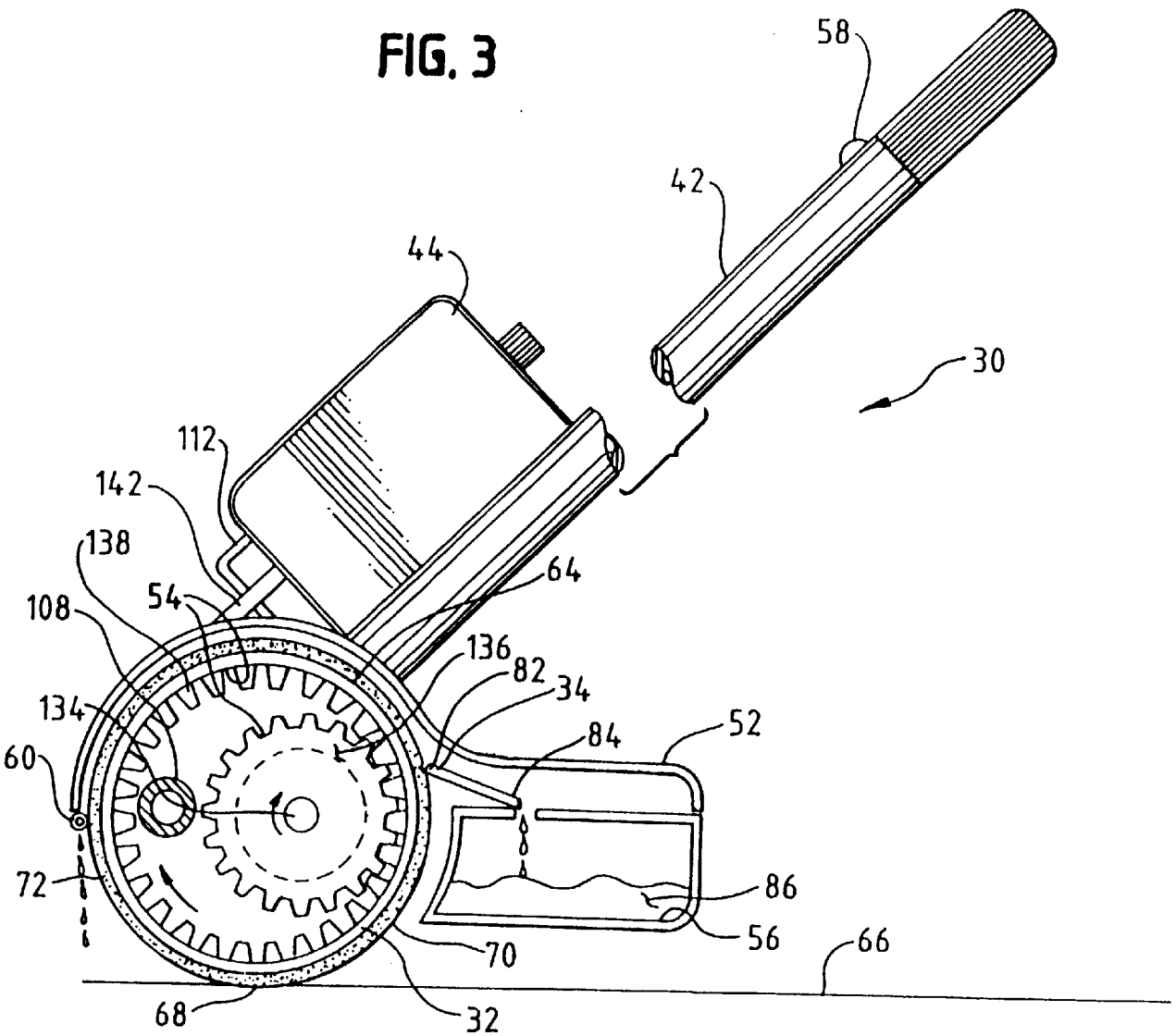
FIG. 3 is a view similar to FIG. 1, but showing parts in a section taken along line 3—3 of FIG. 2.

The resilient outer surface 64 rotates about the axis 62 as the implement 30 is driven on the hard surface 66. In the illustrated embodiment, the roller 32 is driven clockwise as illustrated in FIGS. 1 and 3. Therefore, under the normally intended conditions of use, when the implement 30 is driven to the left as illustrated in FIG. 1, the clockwise rotation of the roller 32 causes a portion 70 of the resilient outer surface 64 which has previously been stripped of fluid to first rotate to the position 68, into contact with the hard surface 66, and then further rotate to the position 72, out of contact with the hard surface 66. This rotation causes the resilient outer surface 64 to be compressed as it contacts the hard surface 66 and to expand, due to its resilience, as it leaves the hard surface 66 and achieves the position 72 and positions further clockwise as illustrated in FIG. 1.

The resilience and absorbency of the outer surface 64, combined with the rotation of the roller 32 and the interference of the outer surface 64 with the hard surface 66, cause the outer surface 64 to expand where it is leaving the hard surface 66, thereby drawing in and absorbing any excess fluid which happens to be on the hard surface 66. In this manner, the absorbent outer surface 64 is able to remove a waste fluid from the hard surface 66 when the implement 30 is being used.

In the embodiment illustrated in FIGS. 1–6, a drive generally indicated as 54 in FIG. 3 is provided for rotating the roller 32 clockwise about its axis with respect to the housing 52 and the handle 42. The handle 42 has a proximal end generally indicated at 74 in FIG. 1 and a distal end generally indicated at 76 in FIG. 1. The roller 32 is operatively connected to the proximal end 74 of the handle 42, and the distal end 76 of the handle 42 generally defines a grippable portion which can be grasped in the hands of an operator.

In one embodiment of the invention, when the handle 42 is being pushed to the left as illustrated in FIG. 1 to translate the implement 30 across the hard surface 66, the drive for the roller 32 is at the same time actuated to drive the roller 32 clockwise, so that the surface 64 at the point 68 contacting the hard surface 66 is moving with a surface velocity faster than the speed of translation of the handle 42 and thus the roller 32 across the hard surface 66. This causes relative movement between the point 68 of the outer surface 64 and the hard surface 66, causing a scrubbing or buffing motion of the outer surface 64 relative to the hard surface 66 being cleaned. This buffing action can advantageously be used to scour or buff the surface 66 to effect cleaning or other useful frictional engagement.

In an alternate embodiment of the invention, the drive 54 could be omitted, and the driving force could be provided by an operator pushing the handle 42 alone. The term "drive" as used here includes a mechanism in which the handle 42 is adapted to be driven using the muscle power of the operator, a towing vehicle or device, or other outside means not illustrated in FIGS. 1–6. A mechanism can be arranged for causing the surface velocity at the point 68 to differ from the translational velocity of the roller 32 along the floor 66 by well known means, such as manually driven drive rollers which in turn drive scouring rollers at a different peripheral velocity.

In the embodiment of FIGS. 1–6, it is contemplated that the implement 30 will be adapted to be translated forward at about normal walking velocity along a hard surface by an operator. It is further contemplated that the drive generally indicated at 54 will turn the roller 32 at a surface velocity different from the normal walking velocity at which the implement 30 is being driven.

As used here, the term "rotation at a surface velocity greater than normal walking velocity" comprehends the situations in which the roller 32 is rotating clockwise to any degree and is being translated forward or to the left as shown in FIG. 1 at the same time, and further comprehends the situation in which the roller 32 is rotating counterclockwise more quickly than its surface 68 is being translated relative to the surface 66, thus providing a scuffing action against the hard surface 66. This term further comprehends a situation in which the roller 32 is being slid sideways to any degree along the hard surface 66, such as by manipulation of the handle 42, or any other conditions under which the surface 68 is moving relative to the portion of the hard surface 66 which it contacts, thereby providing a scrubbing action. As used herein, the term "normal walking velocity" will be taken as a velocity of less than about 4 miles per hour, so that a surface velocity which is at least about 4 miles per hour will be regarded as a surface velocity greater than the normal walking velocity is defined herein.

One advantage of the present invention is its versatility in the ways in which it can be manipulated to cause the surface 68 to move relative to the hard surface 66 as the implement 30 is being used. This relative motion can occur even if the drive 54 is temporarily stopped, and thus locks the roller 32 against rotation about its axis 62. Thus, scrubbing action can be effected by moving the roller 32 axially instead of rotationally, by pushing the handle 42 like a conventional lawn mower is pushed, by grasping the handle 42 in one or both hands much as a mop or broom is grasped to manually push or pull the surface 68 along the hard surface 66, and in other ways which will be evident to a person skilled in the art who is fully cognizant of the features and capabilities of the device 30.

Now the shear member generally indicated at 34 will be described. A shear member like the member 34 is illustrated, for example, in U.S. Pat. No. 3,789,449. That patent is hereby incorporated by reference in its entirety to illustrate the operation of a shear member such as 34 with respect to a roller such as 32 having a resilient surface such as 64. Now referring in particular to FIG. 3, the shear member 34 is disposed near the absorbent outer surface 64, defining a fluid transporting surface 80 (here, simply the upper surface of the shear member 34). The fluid transporting surface 80 has a first portion 82 and a second portion 84.

In the implement 30 as illustrated in FIG. 3, the shear member 34 is in its first position in which it is able to shear fluid from the surface 64 via the first portion 82 and to channel the shear fluid to the second portion 84 and from there into the staging area 56 which is a temporary reservoir. Although the temporary reservoir 56 is shown to be of substantial size in FIG. 3, it will be appreciated that the staging area 56 could be as large as illustrated or could be much smaller in one or more dimensions so as to contain only a small volume of fluid. In any case, it is convenient to have a gravity fed staging area 56 which extends below the level of the first portion 82 of the shear member 34.

Figure 4:
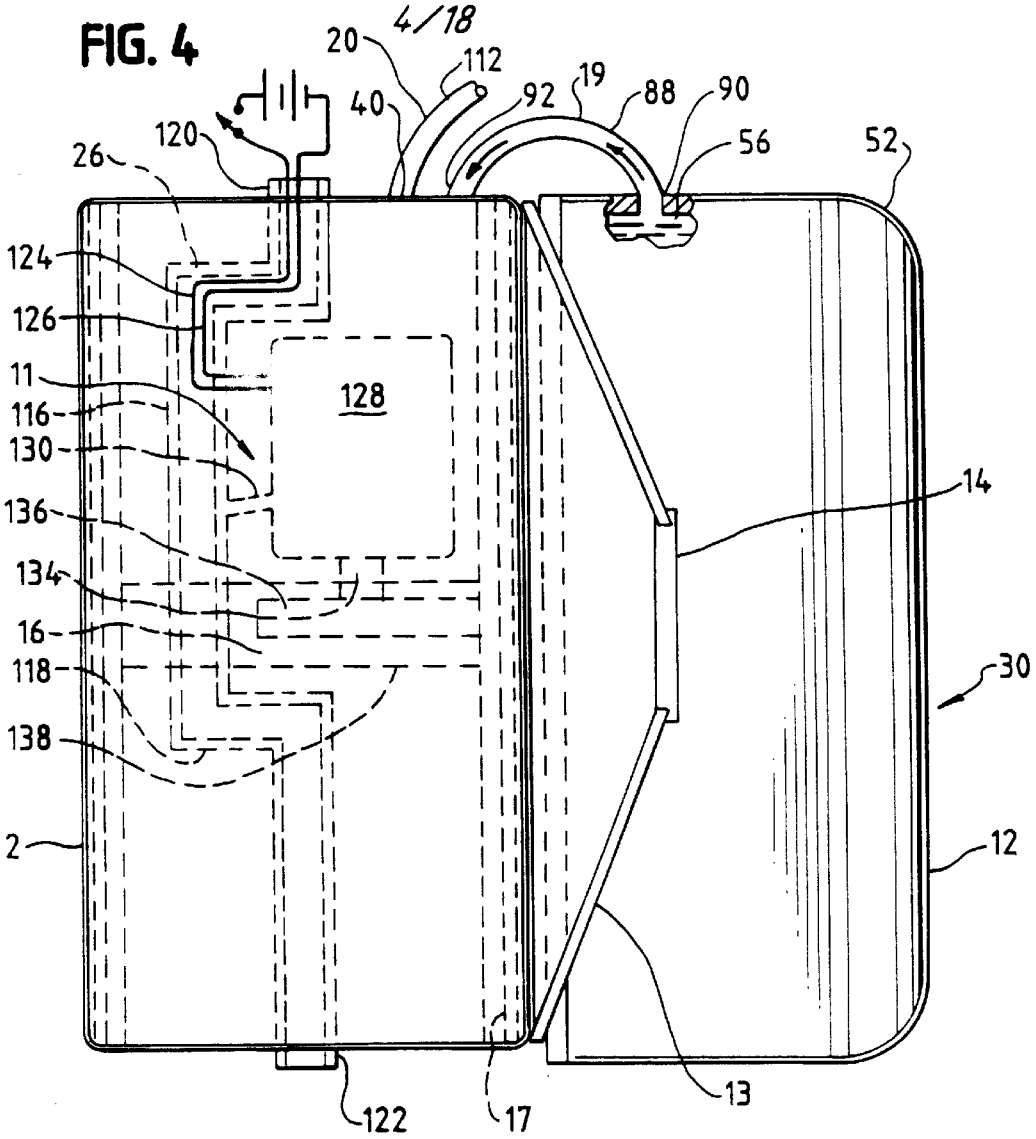
FIG. 4 is a fragmentary top plan view similar to FIG. 2, with underlying structure shown in phantom.

Referring now in particular to FIG. 4 in relation to FIG. 3, the waste fluid 86 contained in the staging area 56 is further conveyed out of the staging area 56, whether continuously or at periodic intervals, so that the capacity of the implement 30 will not be limited by the capacity of the reservoir 56. While a gravity drained system could be used, it will generally be more appropriate to provide a positive pumping arrangement to keep the level of the fluid 86 in the reservoir or staging area 56 below a predetermined maximum level. The pump can be part of the implement 30 or it can be merely connected to the implement 30 by a hose or other suitable conduit.

Referring to FIG. 4, the staging area 56 has an outlet 90 to which a conduit 88 is connected in fluid receiving relationship. The waste fluid 86 flows through the conduit 88 in the direction generally indicated by arrows. The outlet 90 should be at or near the lowest portion of the staging area 56, so that the amount of fluid 86 can be kept at a very minimal level if desired. The outlet of the conduit 88 is generally indicated at 92.

FIG. 5 illustrates that the outlet 92 of the conduit 88 corresponds to the inlet of the pump 38, which in the illustrated embodiment is a peristaltic pump. The peristaltic pump 38 can also be seen in part by reference to FIG. 6. The peristaltic pump 38 has an inlet 92 and an outlet 40. The inlet 92 is at least normally in communication with the second portion 84 of the shear member 34 via the staging area 56, the outlet 90, the conduit 88, and its outlet 92, which also is the pump inlet.

The peristaltic pump 38 works as follows. Fluid flowing due to gravity into the inlet 92 collects in the sump generally indicated at 94 of an O-shaped flexible walled tube 96 which is fixed to the side wall 98 of the housing 52. Thus, the tube 96 does not rotate when the implement 30 is operated normally. The pump impeller illustrated in FIG. 5 and FIG. 6 consists of a pair of rollers 100, 102 which are rotatably carried on stub shafts 104 and 106, respectively. The stub shafts 104 and 106 are mounted on an end wall 110 of the roller 32, so that the rollers 100 and 102 orbit about the axis 62 and are free to rotate relative to their respective stub shafts 104 and 106 as the roller 32 rotates about the axis 62. Thus, the rollers 100 and 102 are driven in a clockwise orbit about the axis 62, with reference in particular to FIG. 5.

The roller 100 pinches the flexible wall tube 96, and either partially or substantially entirely closes the contacted portion of the tubing 96 (depending upon the design and operating conditions of the pump). The roller 100 rolls due to frictional engagement with the wall of the tube 96, thereby driving any fluid which may be found to the right of the roller 100 clockwise within the tubing 96 toward its outlet 40. In a similar fashion, the orbiting and rotation of the roller 102 with respect to the tubing 96 pinches the tubing partially or substantially shut, forcing any fluid which may be to the left of the roller 102, as shown in FIG. 5, clockwise against the influence of gravity. At the same time, the orbiting of the roller 102 in a clockwise direction opens up a space to the right of the roller 102, allowing fluid entering via gravity through the inlet 92 to collect in the sump 94 when the roller 102 is located clockwise of the sump 94. Thus, by rotation of the roller 32, the peristaltic pump generally indicated at 38 forces fluid from its entrance 92 through its outlet 40.

Referring briefly now to FIG. 4, the outlet 40 is connected to the inlet of a conduit 112. Referring back to FIG. 3, the conduit 112 has an outlet 114 which drains into the waste fluid reservoir 46 best shown in FIG. 2. Thus, the operation of the peristaltic pump 38 pumps fluid from the staging area 56 to the waste fluid reservoir 46.

Since the pump 38 may periodically require servicing or repair, an access door may be provided in the portion of the housing 52 adjacent to the pump 38.

In an alternate embodiment of the invention, the tanks 46 and 56 can be disposed on opposite sides of the axis 62, thereby serving as ballast tanks, so that if the amount of effort needed to lift the distal end 76 of the handle 42 becomes larger than desired, the pumping action of the pump 38 can be used to transform weight horizontally in the device from one side of the axis 62 to the other. This can be accomplished, for example, by positioning the outlet 90 illustrated in FIG. 4 vertically above a minimal level, so that the staging area 56 will fill to a predetermined level before overflow exceeding that level is diverted through the outlet 90. Thus, the maximum weight increasing the load on the handle 42 is defined by the level of the outlet 90. When this level is exceeded, the peristaltic pump 38 will then pump waste fluid into the reservoir 46. Assuming the center of gravity of the filling reservoir 46 is forward of the axis 62, the amount of weight experienced at the distal end 76 of the handle 42 will actually decrease as more fluid is collected and diverted to the reservoir 46. The reservoirs can be configured, sized, and positioned so that when the reservoir 46 is full the weight in the tank 46 will actually more than counterbalance the weight in the tank or staging area 56, thus urging the distal end 76 of the handle upward away from the surface 66. This change in ballast thus can perceptively indicate to the operator that the tank 46 is full and needs to be emptied in order to continue working.

In an alternately contemplated embodiment of the invention, with reference once again to FIG. 4, the conduit 112 can be a flexible hose which directs the waste fluid from the staging area 56 to remote apparatus, such as a collection tank, a drain to a sewer, or some other liquid collection point. If this apparatus is operated in that fashion, it will be tethered to the conduit 112, but on the other hand it will not have any finite capacity limitation other than the limitation of whatever remote apparatus is selected. The device 30 can thus be used, for example, in the same manner as some carpet cleaning apparatus is used—it can be connected by a hose to a remote collection device such as a service truck which has a very large capacity in relation to the capacity of a implement which can conveniently be manipulated by one operator of ordinary strength.

The fresh fluid may also be supplied from a remote source. For example, fresh water may be supplied from a faucet and mixed remotely or in the apparatus with a detergent or other suitable cleaning agent.

Another aspect of the ballast function of the staging area 56 and the waste fluid reservoir 46 is that the efficacy of the cleaning of the surface 66 depends to some degree on how hard the surface 64 bears against the surface 66 during a cleaning operation. A higher force will in many events result in more cleaning effort being expended. To this end, the staging area 56 and or the reservoir 46 can be pre-filled with a ballast fluid, which may or may not be waste fluid, cleaning fluid, or any other particular composition. For example, the tanks can be filled with plain water either partially or fully before cleaning is commenced. As a result, a device 30 as transported and sold can be lighter than it must be to clean efficiently, and can later be filled with fluid to ballast it for use.

With particular reference to FIGS. 3 and 4, the drive mechanism provided in this embodiment of the invention is illustrated. Referring first to FIG. 4, a stationary tubular shaft with a offset portion 116 is non-rotatably mounted to the housing 52 at one or both ends. The respective ends 120 and 122 are thus fixed to the housing 52, but act as bearing surfaces which pass through the end walls such as 110 of the roller 32, thereby supporting the housing 52 and the shaft 116 on the roller 32, while permitting the roller 32 to rotate about its axis 62. The shaft 116 may conveniently be hollow to receive the electrical conduits 124 and 126 which convey electricity in a circuit to an electric motor 128. The motor 128 is mounted, conveniently to the crank portion 118, by suitable means such as a bracket 130.

The interior portion 132 of the roller 32 can be substantially impervious to fluid, as the cylindrical wall 132 and the ends such as 110 of the roller 32 can be made of plastic or other fluid impervious material. A suitable seal bearing can be used to carry the ends such as 110 on the shaft ends such as 120 to prevent fluid from entering axially along the shaft 120 to any substantial degree. The walls 110 can also be axially displaced from the portion of the roller which collects and distributes fluid to avoid the fluid running into the interior of the roller 32. Thus, the electric motor 128 can largely be isolated from the fluid distributed or collected by the device 30. Similarly, the electric conduits 124 and 126 can be isolated from fluid to the necessary degree to function properly.

The electric motor 128 has an outlet shaft 134 which drives a spur gear 136, which in turn is meshed with a ring gear 138 (FIG. 3), which in turn is fixed to the interior wall 132 of the roller 32 concentric with the axis 62. Rotation of the output shaft 134 of the motor 128 drives the roller 32 clockwise as illustrated in the Figures. A further gear reduction may also be provided between the motor 128 and the roller 32 so the relative rotational speeds of the motor and roller will each be suitable.

Figure 2:
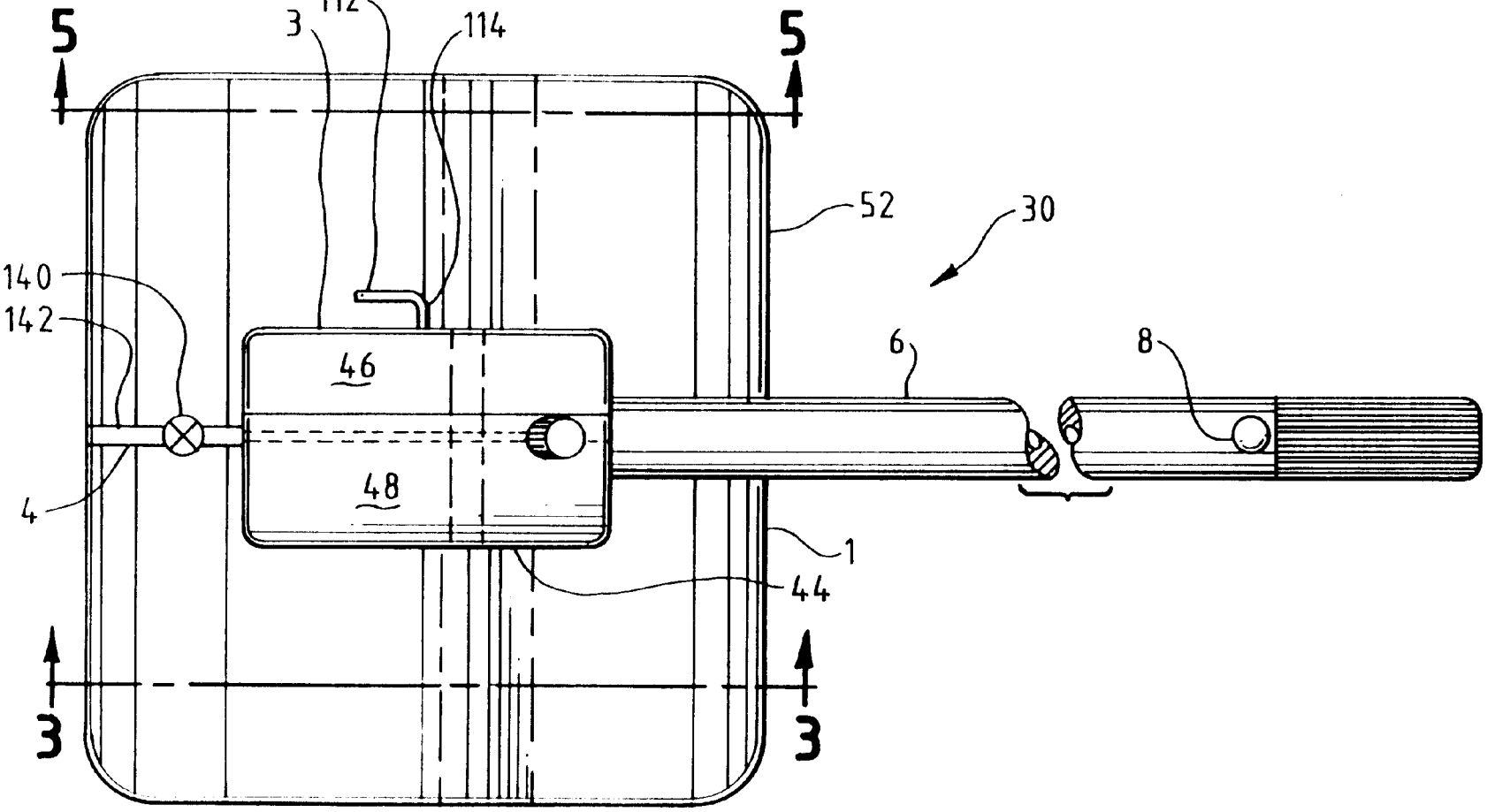
FIG. 2 is a schematic top plan view of the implement of FIG. 1.

Another part of the implement 30 is apparatus for distributing a cleaning fluid to the surface 66, or alternately for distributing some other sort of floor care fluid, such as wax, paint, or other fluids which are to be distributed on the surface 66. Such a fluid may be, for example, a soap solution. Referring briefly to FIG. 2, the soap solution is initially contained in the reservoir 48. The flow of fluid from the reservoir 48 is controlled by a valve 140 which may either be opened or closed, either directly at the valve or remotely. Fluid in the reservoir 48 flows via the valve 140 through the conduit 142, which is also illustrated in FIGS. 1 and 3. The outlet 60 of the conduit 142 will emit a stream 146 when the valve 140 is opened, thus distributing the cleaning fluid stream 146 ahead of the roller 32 on the surface 66. The stream of fluid may also be distributed directly onto the roller.

The scuffing or scouring action of the roller surface 64 relative to the hard surface 66 to be cleaned, after the roller 32 is advanced over an area wet by the stream 146, will cause scouring action at the surface portion 68, facilitated by the presence of a cleaning fluid adjacent to the portion 68. Finally, the reservoir 48 and/or the reservoir 46 may be provided with conventional fittings for filling and emptying each of them, and for fixing each of them to or removing them from the implement 30.

FIGS. 7–16 illustrate a second embodiment of the invention. Mainly, the features of this embodiment which differ from those of the first embodiment will be described, although it will be understood that the features of either embodiment could be incorporated in the other at the election of a designer.

Figure 7:
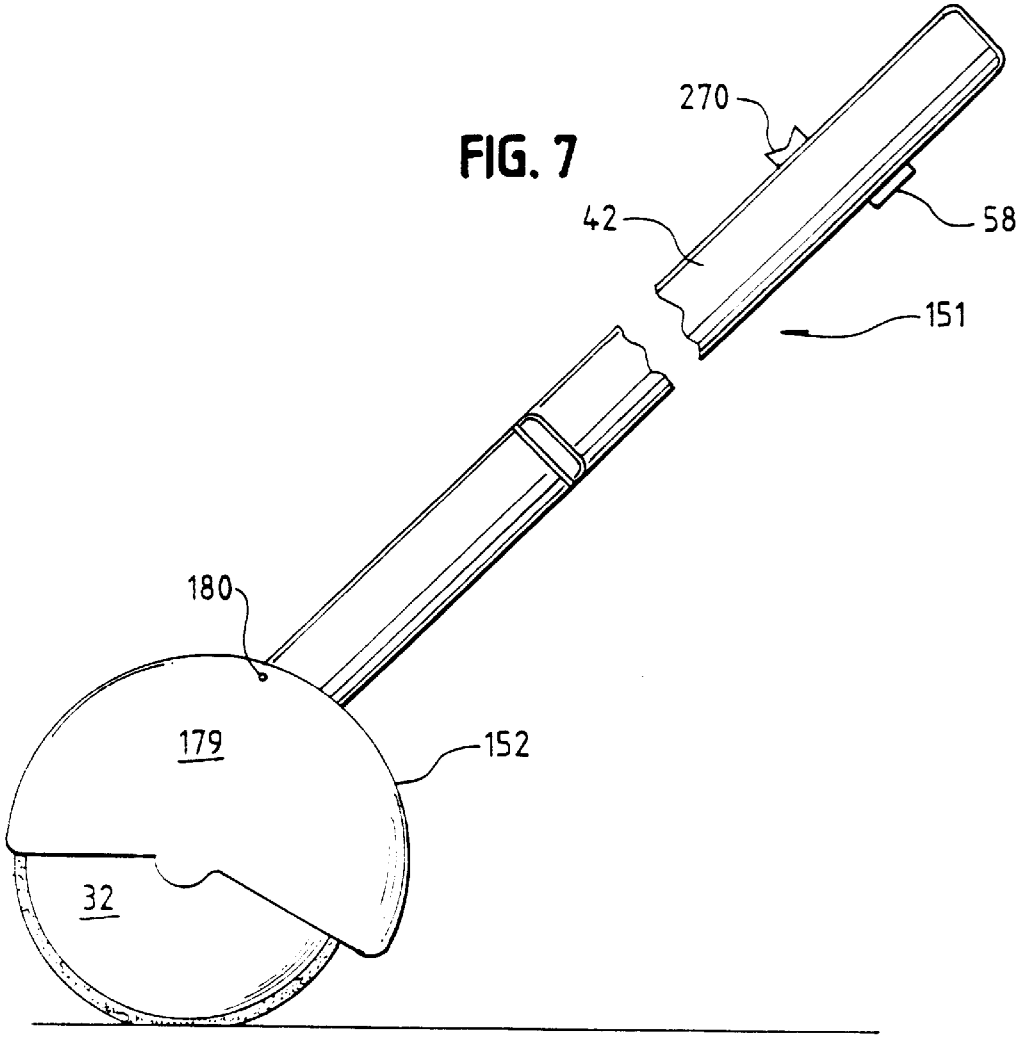
FIG. 7 is a schematic side elevational view of a second embodiment of my invention.
Figure 8:
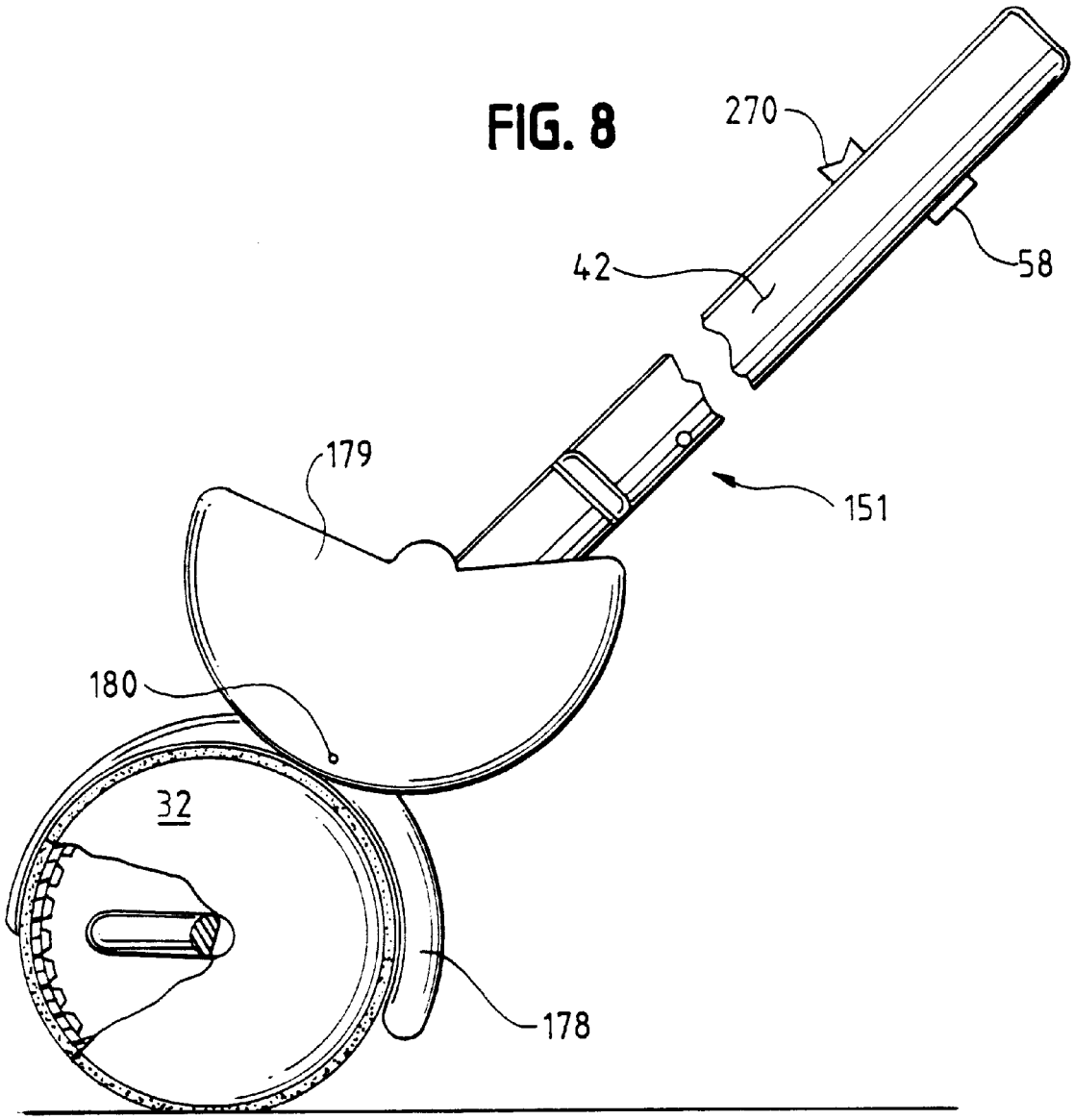
FIG. 8 is a view similar to FIG. 7, but showing a splash guard hatch cover rotated to its open position to reveal underlying structure. Portions of FIG. 8 are cut away to show underlying details.
Figure 9:
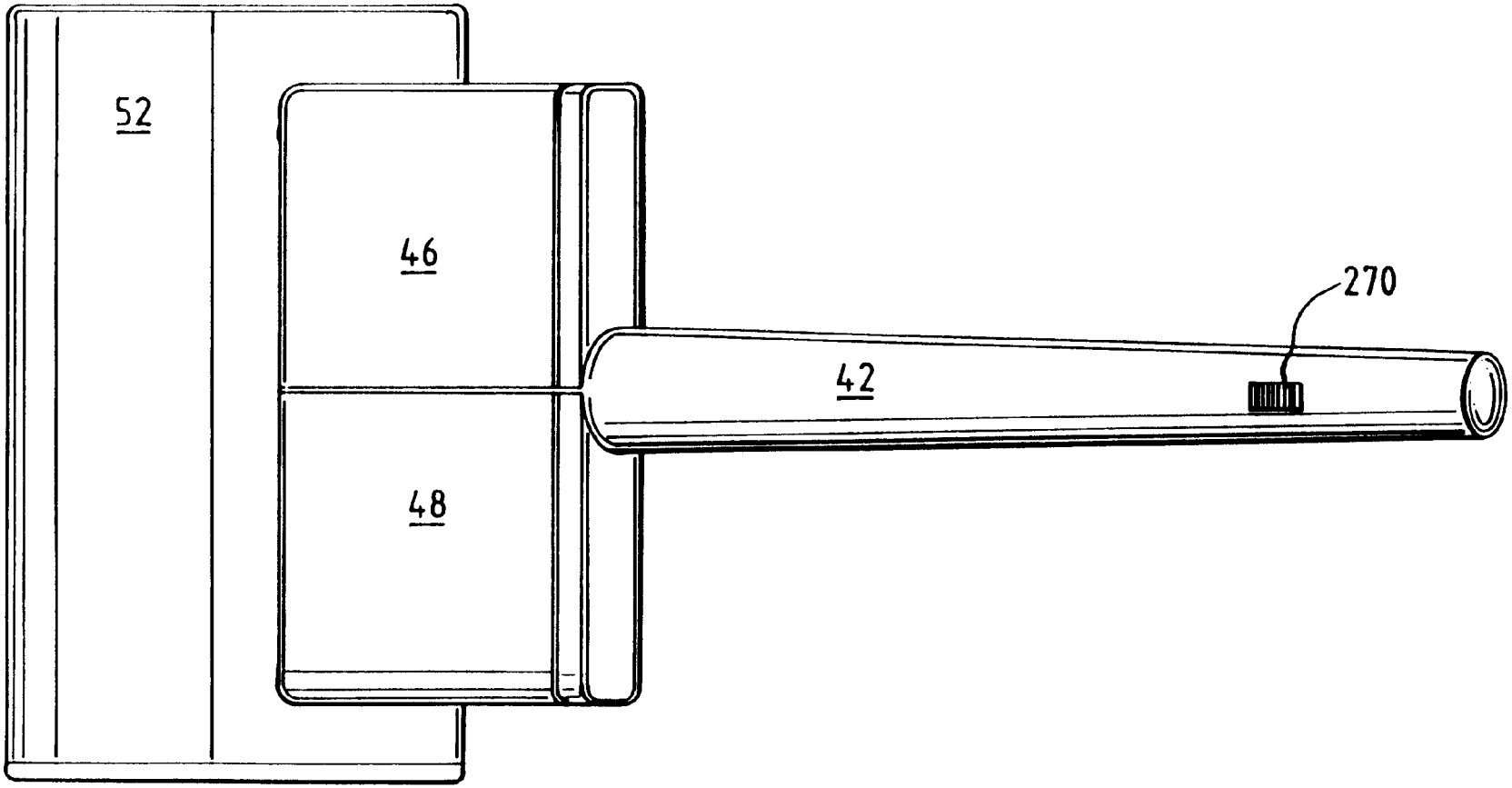
FIG. 9 is a top view of the embodiment of FIG. 7.
Figure 10:
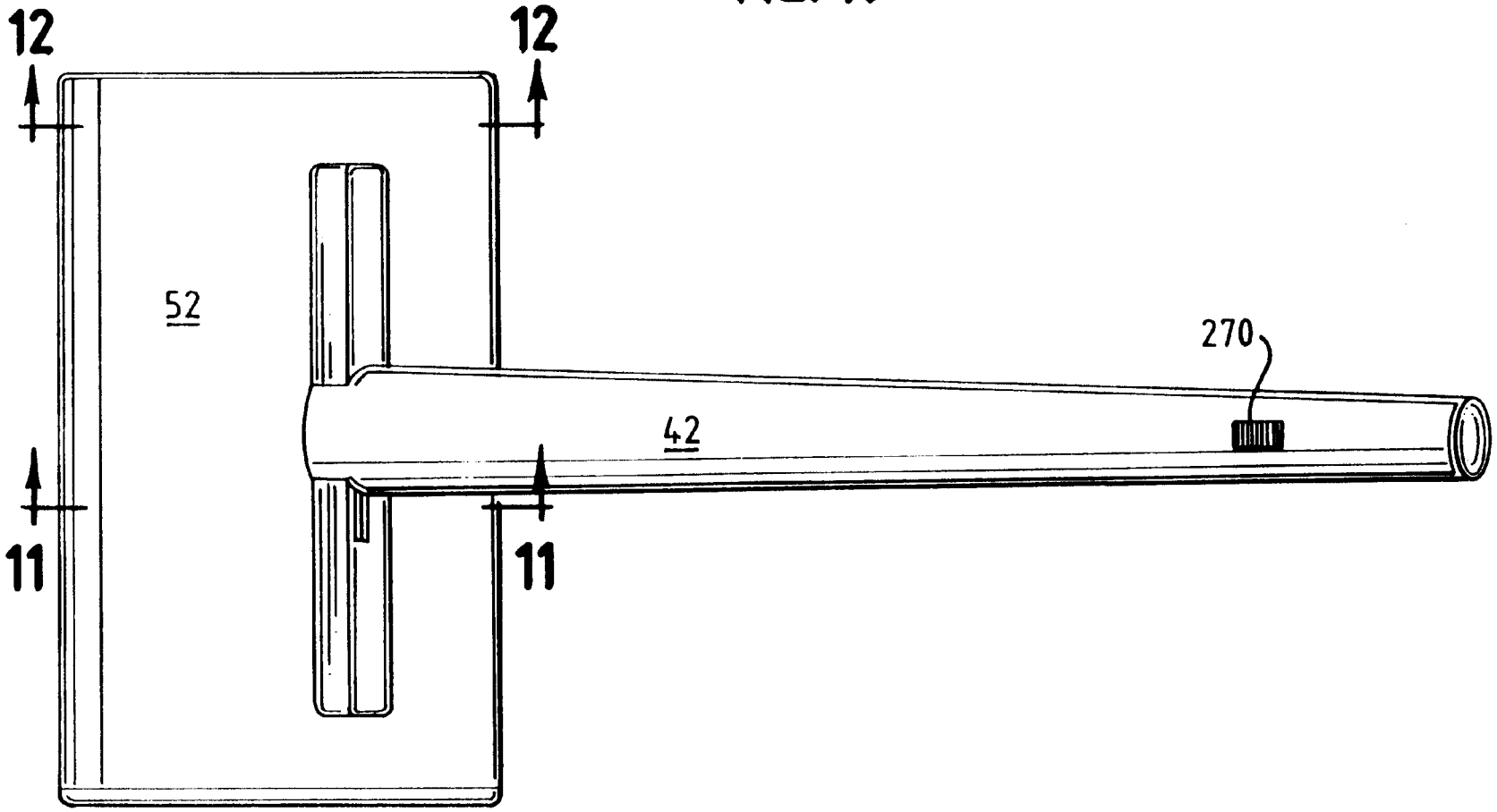
FIG. 10 is a view similar to FIG. 9, but in which the tanks shown in FIG. 9 are removed to reveal underlying structure.

Referring first to FIG. 7, the housing 152 is more compact in the area under the handle 42. The external portion of the housing 152 is just large enough in FIG. 7 to serve as a splash guard. Nonetheless, the embodiment of FIG. 7 still has a staging area, which is indicated here in FIG. 11 and others as staging area 156.

Figure 11:
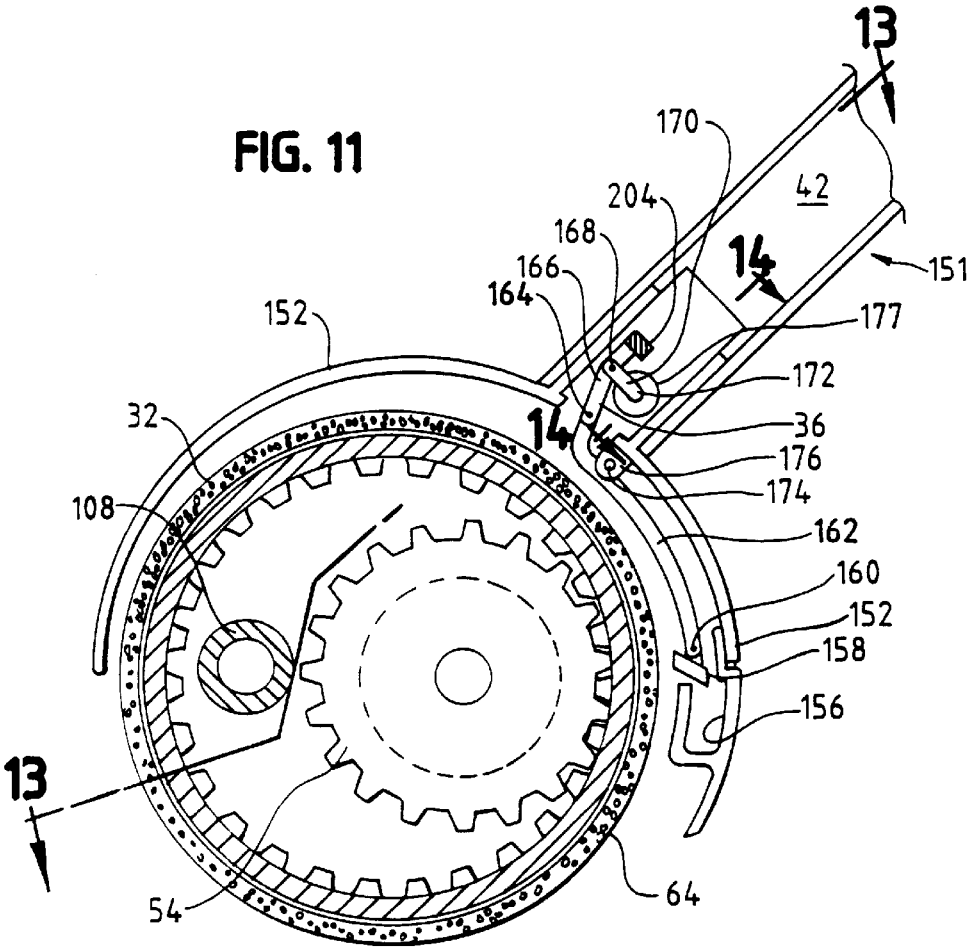
FIG. 11 is a sectional view taken along section line 11—11 of FIG. 10.
Figure 19:
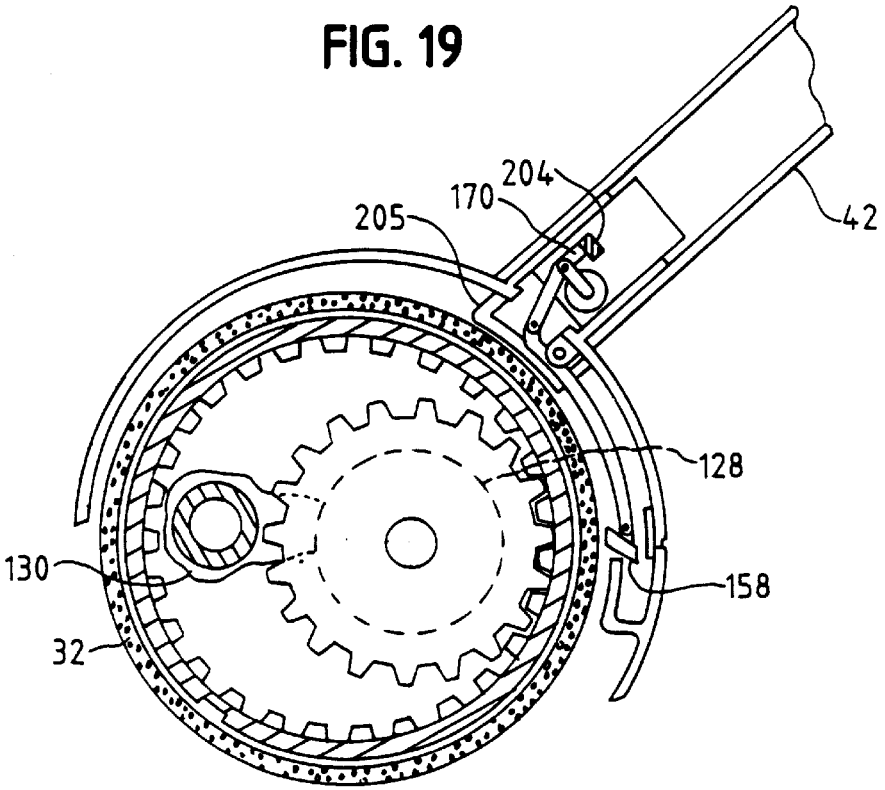
FIG. 19 is a section taken along section line 19—19 of FIG. 17, but with the tanks shown in FIG. 17 removed for greater clarity of illustration.

Referring in particular to FIGS. 11 and 19, the shear member 158 has the same essential features as the previously described shear member 34 in FIG. 3. However, in FIG. 11 a particular mechanism 36 for shifting the shear member 158 between its first and second positions is illustrated.

With reference to FIG. 11, the shear member 158 is pivoted about a pin 160 mounted to a link 162. The link 162 is linked by a pivot 164 to a link 166. The link 166 is pivotally linked by a pin 168 to a crank 170 which is rotatable about a axis 172 to fractionally orbit the pin 168 about the axis 172. The link 162 is also pivoted about a pin 174 which is carried by tabs such as 176 fixed to the housing 152.

The linkage described in the previous paragraph works as follows to operate the shear member 158. The crank 170 is rotated about the axis 172 by a servo motor 177 which is configured to rotate fractionally clockwise (as shown in FIG. 11) between the second position illustrated in FIG. 11 and a first position. Clockwise rotation of the crank 170 pulls the link 166 up and to the right, which pivots the link 162 clockwise about its pivot 174, which urges the shear member 158 against the resilient outer surface 64. Then, counterclockwise rotation of the crank 170 has the opposite effect. Alternatively, the shear member may instead be moved from its first to its second position by a solenoid, a mechanical linkage operated by a lever or link accessible from the handle 42, or any other desired arrangement.

When fluid is to be collected in the staging area 156 (for the same purposes and in essentially the same manner as described in connection with FIGS. 1–6), the shear member 158 is shifted to the left from its position out of engagement with the roll outer surface 64 (as illustrated in FIG. 11) to a position at least substantially in contact with the surface 64. To shift the shear member 158 to its first position, the crank 170 is rotated fractionally by the servomotor 178 clockwise. In this embodiment, the staging area 156 is more in the nature of a gutter, and can conveniently be either level or inclined downward toward the outlet 90 illustrated in FIG. 4. With that arrangement, the staging area 156 can be very minimal in extent, as it only needs to contain the small amount of fluid which has not yet passed through the pump 38.

Instead of essentially translating the shear member 158 to the left or right as shown in FIG. 11, the shear member 158 can instead be sized, positioned, and mounted to pivot about its longitudinal axis (which extends perpendicular to the paper in FIG. 11) between its first and second positions. For example, one or both ends of the shear member 158 can be pivotally mounted on the side walls such as 98 and a linkage similar to the one described above can be used to pivot the shear member 158 between its first and second positions.

Figure 12:
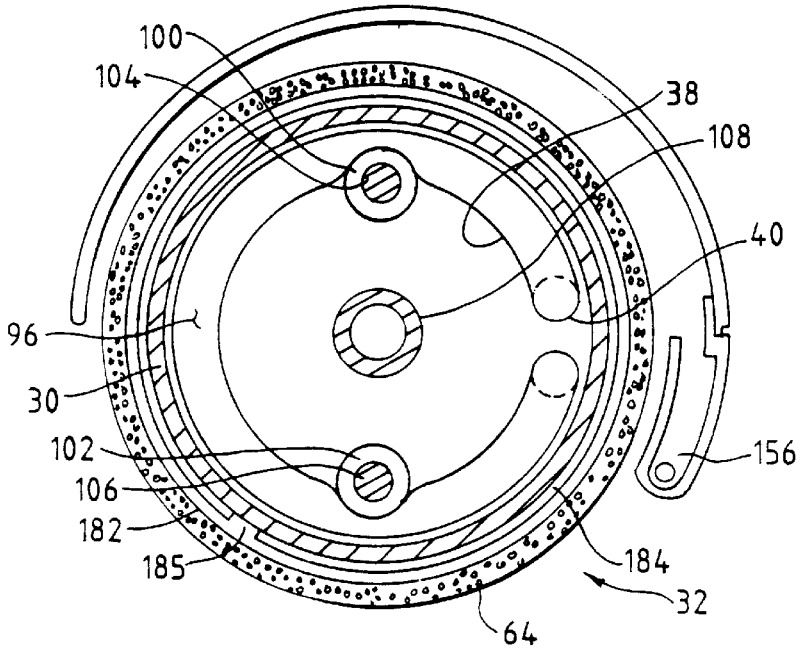
FIG. 12 is a sectional view taken along line 12—12 of FIG. 10.

The staging area 156 can have integral end walls such as 178 which form a part of the housing 152, or it can be removable as shown in FIGS. 11 and 12. A removable staging area is easier to clean, should it become clogged with debris.

The small extent of the staging area 156 and the presence of a splash guard 152 and end walls such as 178 completely hide the staging area 156 from the user. The splash guard 152 can include a pivoting cover 179, illustrated in FIGS. 7, 8, and 13, which is pivotable about the pivot pin 180 with the bias of the spring 181 and against the bias of gravity between the position illustrated in FIG. 7, closing the splash guard, to the position shown in FIG. 8, allowing access to the roller 32. Such access is occasionally necessary, as for replacing or inspecting the roller, its resilient cover, or other interior components. A compression spring, gravity, detents, or other suitable means can be used to keep the cover 179 normally in its closed position as illustrated in FIG. 7.

FIG. 12 also illustrates an arrangement for removably attaching the resilient cover 64 to the interior structure of the roller assembly 32. The outer cover 64 is glued or otherwise secured to the outer sleeve 182, which is made of relatively rigid material. The outer sleeve 182 is slidably received by the inner sleeve 183, which is permanently rotatably mounted to the side walls such as 98 of the housing 52. The outer and inner sleeves 183, 182 respectively have an integrally formed key 184 and keyway 185 which allow the outer sleeve 182 to slide axially but not shift circumferentially on the inner sleeve 183. Thus, the resilient outer surface 64 is readily removable for cleaning, replacement, or the like but positively driven by the inner sleeve 183.

Figure 13:
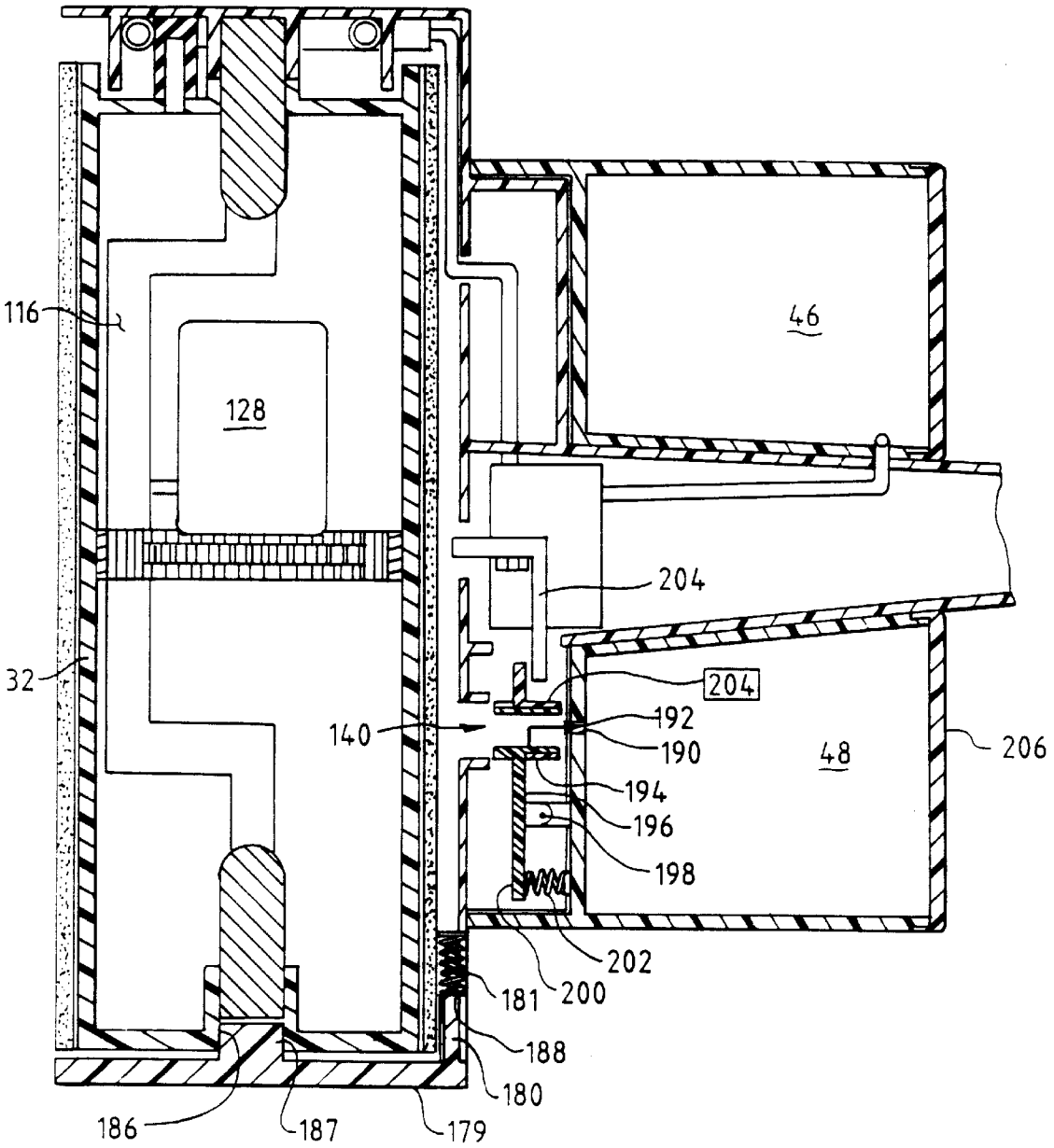
FIG. 13 is a section taken along section line 13—13 of FIG. 11.

FIG. 13 shows additional details of the cover 179. Referring to FIG. 13, the housing generally indicated at 152 has a recess 186 sized to receive a boss 187 of the pivoting cover 179. The boss 187 is removed from the recess 186 or inserted into the recess 186 by flexing the cover 179 axially of the roller 32. The pivot pin 180 carries a cover bias spring 188 which normally biases the cover about the pivot pin 180 to the closed position shown in FIG. 7. The cover 179 can be rotated against that bias to open it to the position shown, for example, in FIG. 8.

Another detail shown by FIG. 13 relates to the valve 140 schematically illustrated in FIG. 2. Flow through the outlet 190 of the fresh fluid reservoir 48 is controlled by a valve element or poppet 192 which can selectively be advanced into the outlet 190 to block it or out of the outlet 190 to allow fluid to pass about the poppet 192. The poppet 192 is mounted within a flow guide tube 194 defining one end of a rocker arm 196 carried on a pivot 198. The opposite end 200 of the rocker arm 196 is opposed about the pivot 198 and normally biased to the left (in FIG. 13) by a compression spring 202. This biases the poppet 192 to the right (in FIG. 13), closing the outlet 190. A valve operator 204 is provided to counteract the bias of the spring 202, rocking the poppet 192 out of the outlet 190 to allow a flow of fluid to commence from the reservoir 48, through the fluid distribution channel 205 (FIG. 19), which dispenses the fluid onto the roller 32.

In this embodiment, the valve operator 204 is part of the servo motor arrangement and linkage previously described with reference to FIG. 11. Specifically, the valve operator 204 is located on the link 162, and opens the valve when the crank 170 is turned counterclockwise (as shown in FIG. 11) of its centered position by the servo motor 177. The valve operator 204 may instead be a solenoid, a lever operated from and located on the handle 42, or any other desired type of control arrangement. If the fluid dispersion element 205 is gravity fed, the valve should be located lower than the fresh fluid source.

One convenient aspect of the valve assembly of FIG. 13 is that, as illustrated, it is a normally closed valve mounted directly on the fluid tank 206 defining the reservoir 48. The tank 206 can be removed without leaking because the valve poppet 190 is normally biased closed by the spring 202.

Figure 14:
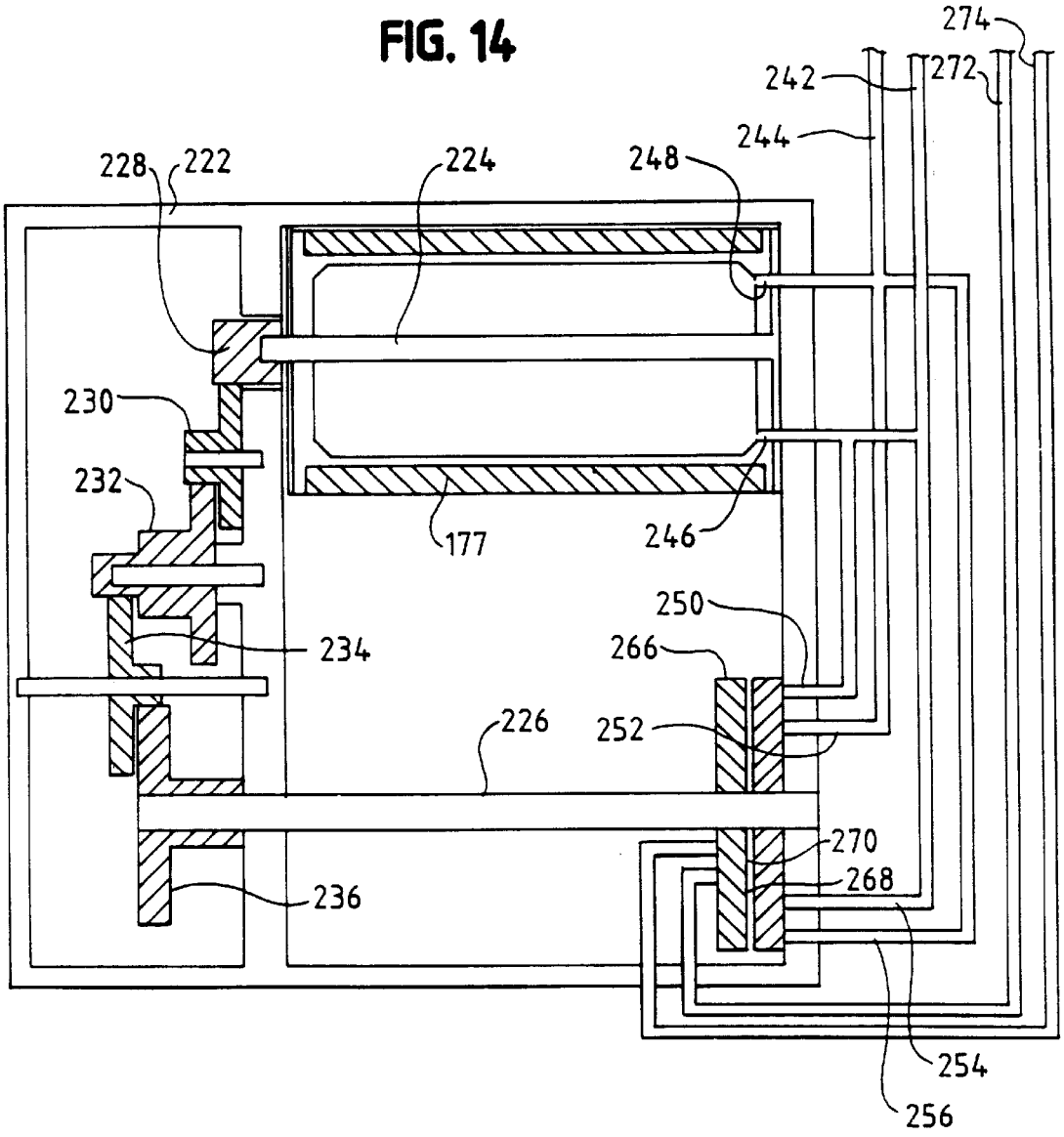
FIG. 14 is a schematic sectional view taken along section line 14—14 of FIG. 11.
Figure 15:
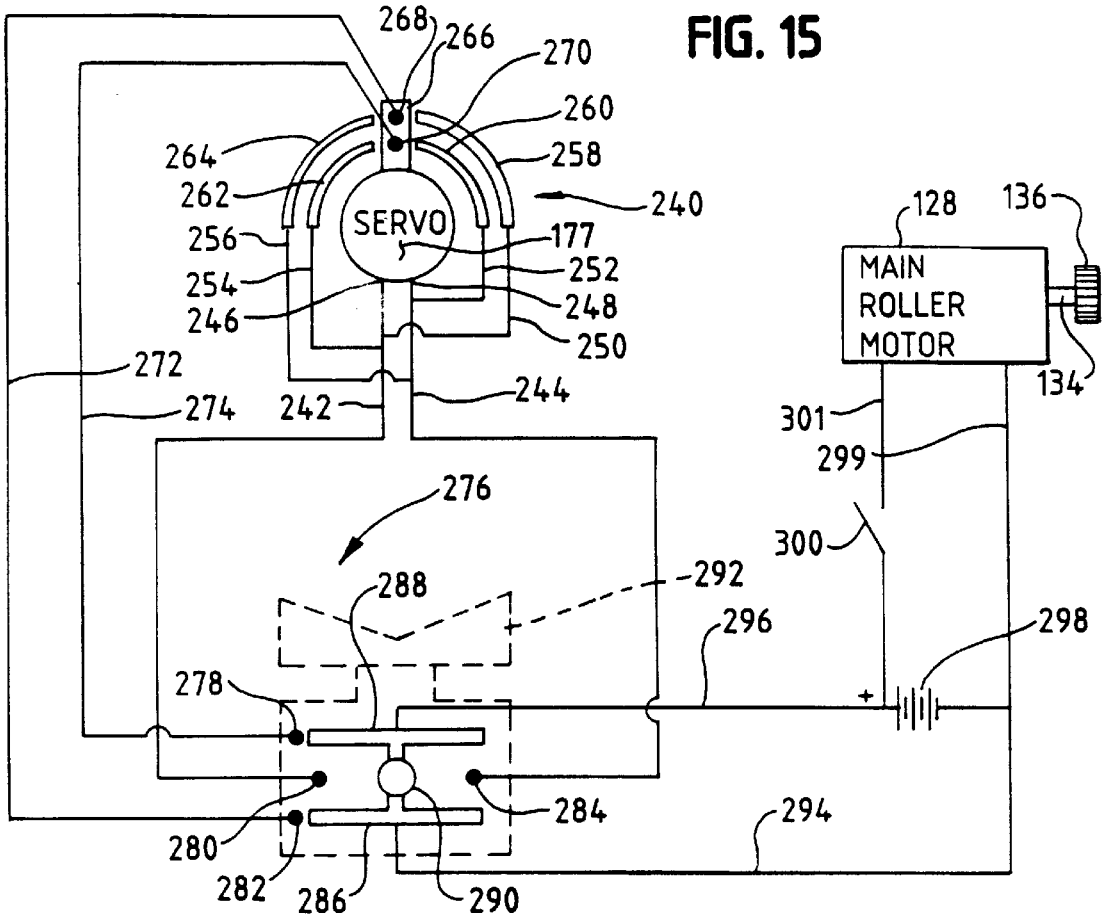
FIG. 15 is a schematic view of the circuit used in the embodiment of FIGS. 7–16.

FIGS. 14 and 15 are a schematic representation of the drives and control systems shown in the previous figures.

Referring first to FIG. 14, the servo motor 177 is supported in a gear case 222 which is placed at a convenient location associated with the main housing 52. In this embodiment, the servo motor 177 has an output shaft 224 which rotates to drive a drive shaft 226. The drive shaft 226 rotates fractionally in one direction to shift the shear member 34 to its first position. The drive shaft 226 rotates fractionally in the other direction to open the valve 140. When the drive shaft 226 is centered in its rest position, the shear member 34 is in its second position and the valve 140 is closed.

The coupling between the output shaft 224 and the drive shaft 226 is a gear train consisting of the output gear 228 and meshed reduction gears 230, 232, 234, and 236. The output gear 228 is splined, keyed, or otherwise securely and rotatably attached to the output shaft 224. Similarly, the output gear 236 is securely attached to the shear blade linkage drive shaft 226, thus providing a positive drive linkage between the shafts 224 and 226.

Also noted on FIGS. 14 and 15 are a positional tracer 240 and conductors 242 and 244. Conductors 242 and 244 respectively connect to the terminals 246 and 248 of the servo motor 177, to the conductors 250 and 252, and to the conductors 254 and 256 of the positional tracer 240.

Referring now in particular to FIG. 15, the wiring schematic of the implement 30 is provided. The additional parts shown in FIG. 15 include the conductive paths 258, 260, 262, and 264, an armature 266 carrying two sliding contacts 268 and 270, and conductors 272 and 274. FIG. 15 also shows a rocker switch 276 having contacts 278, 280, 282, and 284; electrically isolated, mechanically connected switch elements 286 and 288 which rock about a pivot 290; and a switch rocker handle 292. Power is brought to the rocker switch 276 by the power leads 294 and 296 and a suitable power supply, such as the battery illustrated as 298 or an external power supply. A switch 300 is also provided to operate the main roller motor 128 from the same power supply 298.

FIG. 15 illustrates how the servo motor arrangement works. The main roller motor 128, its output shaft 134, and its spur gear output 136 have already been described in connection with previous figures. When the servo motor circuit is in the normal or dormant condition shown in FIG. 15, the switch contacts 280 and 284 are normally open and the switch contacts 278 and 282 are normally closed. When the armature 266 has returned to the centered condition of FIG. 15, the contacts 268 and 270 are out of contact with the conductive paths 258, 260, 262, and 264, creating an open circuit between the power leads 294 and 296 and the servo motor terminals 246 and 248, though that circuit is closed through the switch 276. In this dormant condition, the shear member 34 is in its second or disengaged position and the valve 140 remains closed. Thus, water is not being sheared from the roller 32 and new cleaning fluid or some other pertinent fluid is not being dispensed from the fresh fluid chamber 48.

If the rocker handle 292 of FIG. 15 is rocked counterclockwise, the switch element 288 is moved out of contact with the contact 278 and into contact with the contact 280, thus feeding power to the latter contact from the positive side of the power supply 298, via the power lead 296. At the same time, the switch element 286 is moved out of contact with the contact 282 and into contact with the contact 284. Electricity thus flows from the power lead 296 via the switch element 288 to the contact 280, the conductor 242, and the motor terminal 246, thus powering the servo motor 177. Electricity continues to flow from the motor terminal 248, via the conductor 244, the contact 284, the switch element 286, and the power lead 294 to the power supply 298. This operation of the servo motor 177 turns its shaft 224, and thus the shaft 226 (shown in FIG. 14 only) and the armature 266, fractionally clockwise. Although this armature movement brings the contacts 268 and 270 into electrical contact with the conductive paths 258 and 260, this has no effect because the leads 272 and 274 connect the sliding contacts 268 and 270 with the contacts 278 and 282, which are open so long as the rocker handle 292, which is self-centering, is held in its counterclockwise-rotated position.

Thus, pushing the rocker arm 292 counterclockwise (down on the left side) causes the servo motor 177 to turn the output shaft 226 (not shown in FIG. 15) and the armature 266 clockwise. This clockwise shift moves the shear member 34 to its first or engaged position, as FIG. 11 illustrates, while the valve 140 remains closed. Thus, water is being sheared from the roller 32 (assuming the switch 300 is closed so the main roller 32 is turning), but new cleaning fluid or some other pertinent fluid is not being dispensed from the fresh fluid chamber 48. If the rocker handle 292 is then released, it automatically returns to the centered position shown in FIG. 15, where the contacts 278 and 282 are closed. The armature 266, however, was previously displaced clockwise, and thus its sliding contacts 268 and 270 are conducting electricity from the power leads 294 and 296, the switch elements 286 and 288, the contacts 282 and 278, and the conductors 272 and 274 to the conductive paths 258 and 260. This electricity continues, via the conductive paths 258 and 260 and the conductors 250 and 252, to the terminals 246 and 248. Contrary to the situation when the armature was deflected to the right in FIG. 15 by rocking the rocker handle 292 to the left, thus feeding the positive side of the power supply 298 to the motor terminal 246, the positive side of the power supply is fed to the terminal 248 when the rocker handle 292 is centered as shown in FIG. 15 but the armature 266 is to the right of center.

Thus, releasing the rocker handle 292 when the armature 266 has shifted to the right reverses the rotation of the servo motor 177 until the armature 266 returns to its center position where its contacts 268 and 270 are again out of contact with the conductive paths 258 and 260. When that contact ceases, the armature 266 remains centered, as shown in FIG. 15, until disturbed by another operation of the rocker handle 292.

If the rocker handle 292 of FIG. 15 is rocked clockwise, the switch element 288 is moved out of contact with the contact 278 and into contact with the contact 284, thus feeding power to the latter contact from the positive side of the power supply 298, via the power lead 296. At the same time, the switch element 286 is moved out of contact with the contact 282 and into contact with the contact 280. Electricity thus flows from the power lead 296 via the switch element 288 to the contact 284, the conductor 244, and the motor terminal 248, thus powering the servo motor 177. Electricity continues to flow from the motor terminal 246, via the conductor 242, the contact 280, the switch element 286, and the power lead 294 to the power supply 298. This operation of the servo motor 177 turns its shaft 224, and thus the shaft 226 (shown in FIG. 14 only) and the armature 266, fractionally counterclockwise. Although this armature movement brings the contacts 268 and 270 into electrical contact with the conductive paths 262 and 264, this has no effect because the leads 272 and 274 connect the sliding contacts 268 and 270 with the contacts 278 and 282, which are open so long as the rocker handle 292, which is self-centering, is held in its clockwise-rotated position.

Thus, pushing the rocker arm 292 clockwise (down on the right side) causes the servo motor 177 to turn the output shaft 226 (not shown in FIG. 15) and the armature 266 counterclockwise. This counterclockwise shift keeps the shear member 34 in its second or disengaged position, as FIG. 11 illustrates (though it will move), while the valve 140 is opened. Thus, no water is being sheared from the roller 32 (even assuming the switch 300 is closed so the main roller 32 is turning), but new cleaning fluid or some other pertinent fluid is being dispensed from the fresh fluid chamber 48.

If the rocker handle 292 is then released, it automatically returns to the centered position shown in FIG. 15, where the contacts 278 and 282 are closed. The armature 266, however, was previously displaced counterclockwise, and thus its sliding contacts 268 and 270 are conducting electricity from the power leads 294 and 296, the switch elements 286 and 288, the contacts 282 and 278, and the conductors 272 and 274 to the conductive paths 262 and 264. This electricity continues, via the conductive paths 262 and 264 and the conductors 254 and 256, to the terminals 246 and 248. Contrary to the situation when the armature was deflected to the left in FIG. 15 by rocking the rocker handle 292 to the right, thus feeding the positive side of the power supply 298 to the motor terminal 248, the positive side of the power supply is fed to the terminal 246 when the rocker handle 292 is centered as shown in FIG. 15 but the armature 266 is to the left of center.

Thus, releasing the rocker handle 292 when the armature 266 has shifted to the left reverses the rotation of the servo motor 177 until the armature 266 returns to its center position where its contacts 268 and 270 are again out of contact with the conductive paths 262 and 264. When that contact ceases, the armature 266 remains centered, as shown in FIG. 15, until disturbed by another operation of the rocker handle 292.

The circuit of FIG. 15 is thus a two-way, normally self-centering, servo motor arrangement. The illustrated arrangement shifts the shear member 34 to its first position only when the rocker handle 292 is pushed down on the left side. The arrangement opens the valve 140 only when the rocker handle 292 is pushed down on the right side. Finally, the arrangement closes the valve 140 and maintains the shear member 34 in its disengaged or second position when the rocker handle 292 is in its centered or normal position.

FIGS. 16–19 illustrate several details of a third embodiment of the present invention. Apart from the proportions of the respective embodiments, the features of this third embodiment have been described with reference to earlier embodiments, so this description will be confined to new features shown in those Figures.

Figure 16:
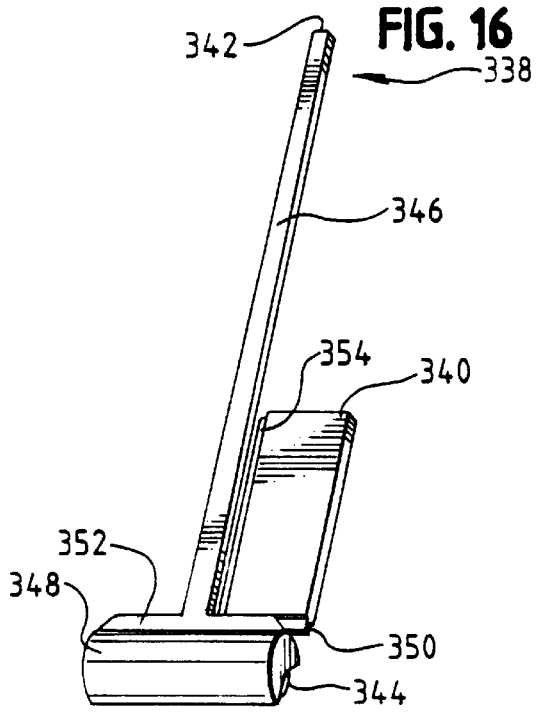
FIG. 16 is a schematic perspective view of a variation of the embodiment of FIG. 7, showing the implement with one of its two tanks partially installed and the other tank removed.

In the embodiment 338 of FIG. 16, one of the two tanks—the tank 340—is illustrated. In this embodiment, the tank 340 is flatter than the tanks shown previously. The overall length of the embodiment 338 from the distal end 342 to its proximal end 344 normally in contact with the ground is about the same as in previous embodiments. In this embodiment, however, the handle 346 is longer relative to the diameter of the splash guard 348 than in prior illustrated embodiments. Also, the length of the tank 340 parallel to the handle 346 is much greater in relation to the thickness of the tank 340 than in the earlier embodiments. FIG. 16 also illustrates tongue and groove arrangements with a tongue 350 of the tank 340 slidably received in the groove 352 and a roughly vertical channel 354 receiving a tongue 356 of the handle 346.

Figure 17:
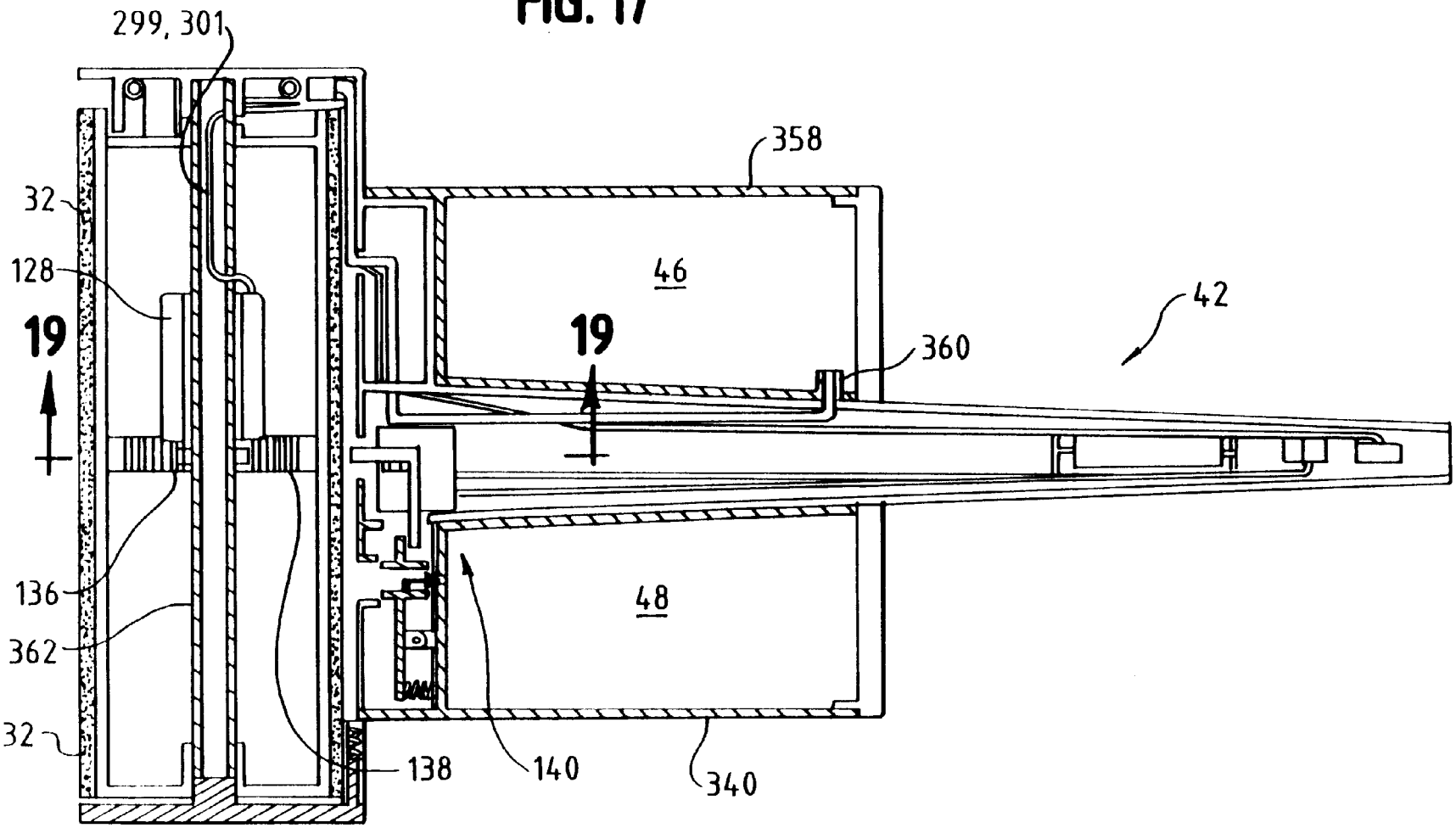
FIG. 17 is a view similar to FIG. 13 of another embodiment of the present invention.

This tongue and groove arrangement provides support for the tank 340 when it is retained in the handle 346. A suitable latch may also be provided to maintain the tank 340 removably in position on the handle 346 and in its respective grooves. A similar provision may be made for mounting the waste fluid tank 358 illustrated in FIG. 17. The tank 340 has the valve arrangement described, for example, as 140 in FIG. 13. FIG. 17 also illustrates in more detail the waste fluid inlet 160 of the waste fluid tank 358. The location of this inlet 160 makes it possible to construct this tank 358 without any valves.

Figure 18:
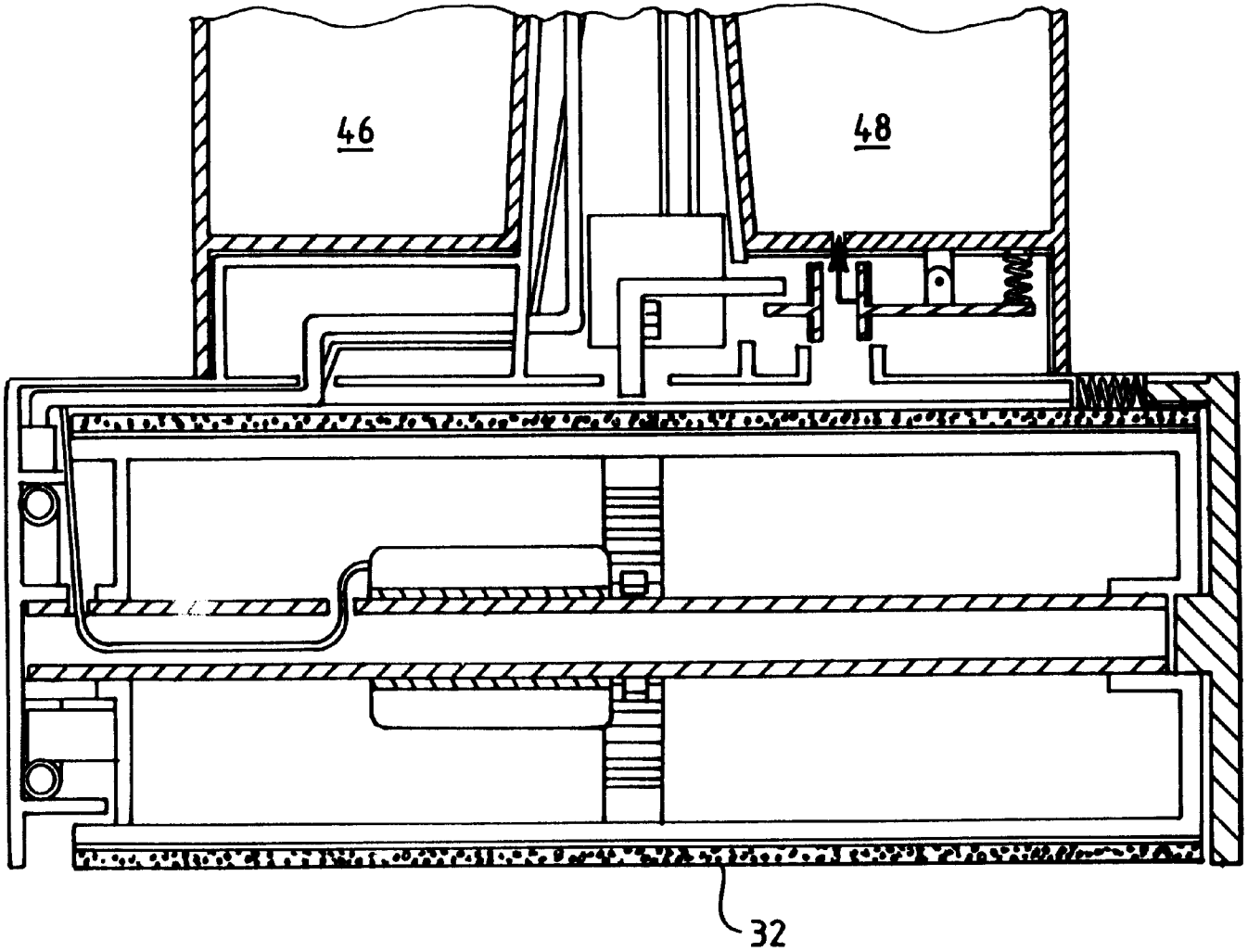
FIG. 18 is an enlarged fragmentary view of the implement shown in FIG. 17.

Another detail shown in FIGS. 17 and 18 which is not shown in previous embodiments is a straight, hollow roller shaft 362 which carries the roller 32. The conductors 299–301 are led through a portion of the roller shaft 362, which does not rotate with the roller 32. The conductors 299–301 are directed to a suitable source of electric power, such as a power cord or a battery. In this embodiment, the spur gear 136 is eccentrically supported relative to the roller shaft 362, as is the motor 128 and consequently its output shaft. The ring gear 138 is shown to be concentrically mounted with respect to the roller shaft 362.

FIG. 19 shows substantially the same details as FIG. 11, but additionally shows the motor 128, the bracket 130, and the fluid distribution channel 205.

Figure 20:
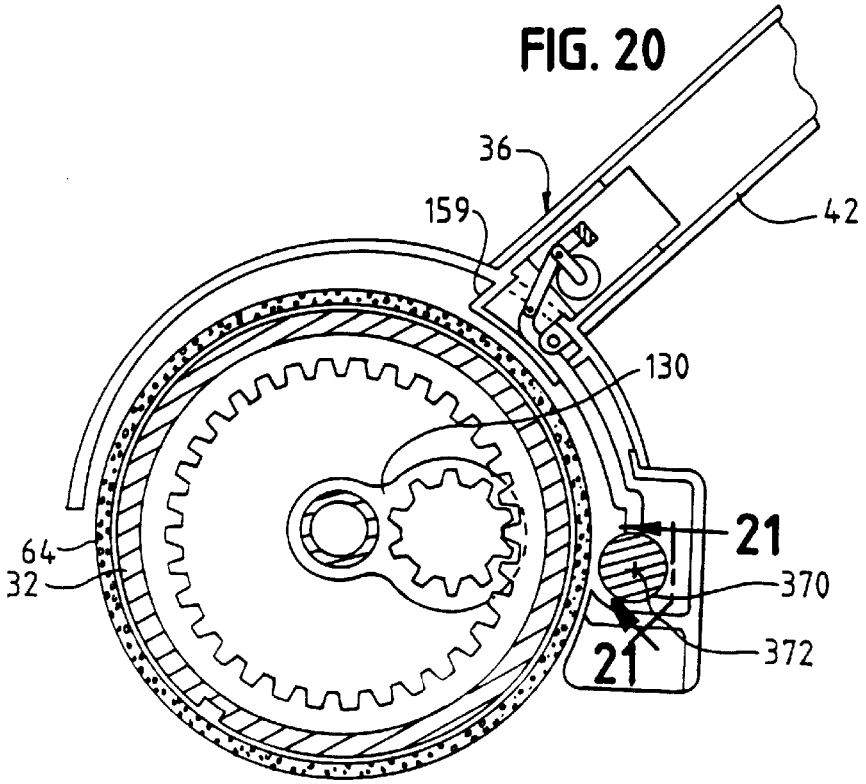
FIG. 20 is a view similar to FIG. 19 of still another embodiment of the structure for removing fluid from the sponge roller shown in the figures.

FIG. 20 shows a fourth embodiment of the invention, with an alternative to the shear member 158 shown in FIG. 19. In FIG. 20, the shear member 158 is embodied as a roller 370 rotatably carried on a bearing shaft 372 and possessing fundamentally the same mechanism previously illustrated in FIG. 19 (with reference to the shear member 158) for causing the shear member 370 to go into or out of contact with the resilient outer surface 64 of the roller 32. In this embodiment, the bearing shaft 372 can be parallel to the roller 32, but also may be tilted out of a horizontal axis, so one end of the roller 370 is slightly higher than the other end. This is illustrated schematically in FIGS. 21 and 22.

Figure 21:
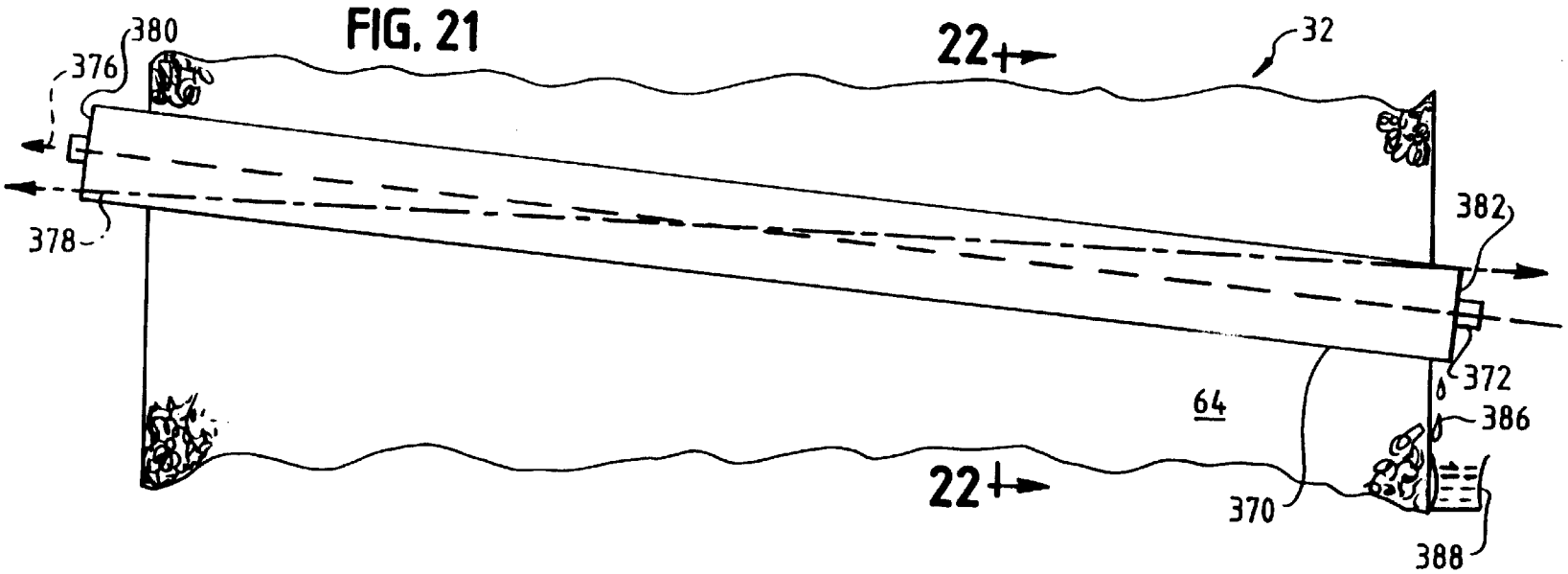
FIG. 21 is an isolated, schematic view of the rollers 370 and 32, showing that they are skewed (with the degree of skew exaggerated for clarity of illustration).

Referring first to FIG. 21, the roller 370 and consequently its concentric bearing shaft 372 rotate about the axis 376 which is skewed relative to the normally horizontal axis 378. Consequently, one end 380 of the roller 370 is higher than the other end 382 of the roller 370 when the axis 378 is disposed horizontally. This effect is exaggerated in FIG. 21 for clarity of illustration.

Figure 22:
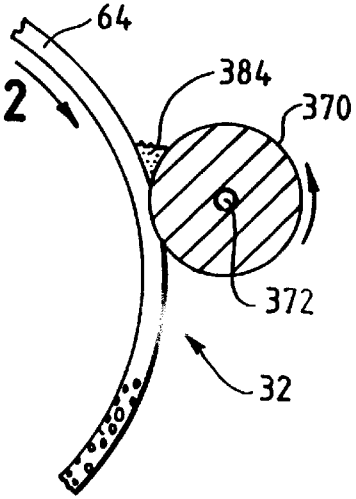
FIG. 22 is a fragmentary section taken along section line 22—22 of FIG. 21.

FIG. 22 illustrates that waste water 384 tends to collect in the upright V-shaped gutter or crevice or channel formed between the surface 64 and the roller 370. The waste water 384 collects because the roller 370 bears against the resilient surface 64, tending to displace the water 384 out of the surface 64 in which it previously has been absorbed. The waste water 384 runs to the right as shown in FIG. 21 along a path parallel to the axis 376 to the lower end 382 of the roll 370 which in this embodiment is outside or axially beyond the end of the roll 32. The waste water 386 dribbles from the position 384 shown in FIG. 22 when the water gets just outside the end face of the roller 32, dribbling into a staging area 388 which functions similarly to the staging areas previously described. This apparatus for removing fluid from the roller 32 would also function if the rollers 32 and 370 were not skewed. Where the shear roller 370 is not skewed, flow of the fluid can be predominantly vertically oriented.

In an alternate embodiment, the roller 32, as shown in FIG. 1, can be rotated counterclockwise, and consequently the movable shear or its pinch roller (in its second position) acts much like the pinch-roller that is described in U.S. Pat. No. 1,010,097. In that design, the liquid flows downward along the length of the roller (despite the rotation of the pinch roller) and drips off the roller into a holding tank.

FIGS. 23–31 show three alternative embodiments of the shear roller 370 of FIG. 21 and others which are adapted to capture and internally channel water generally along the axis 376 of the roller analogous to 370, encouraging flow from left to right as shown in FIG. 21.

Figure 23:
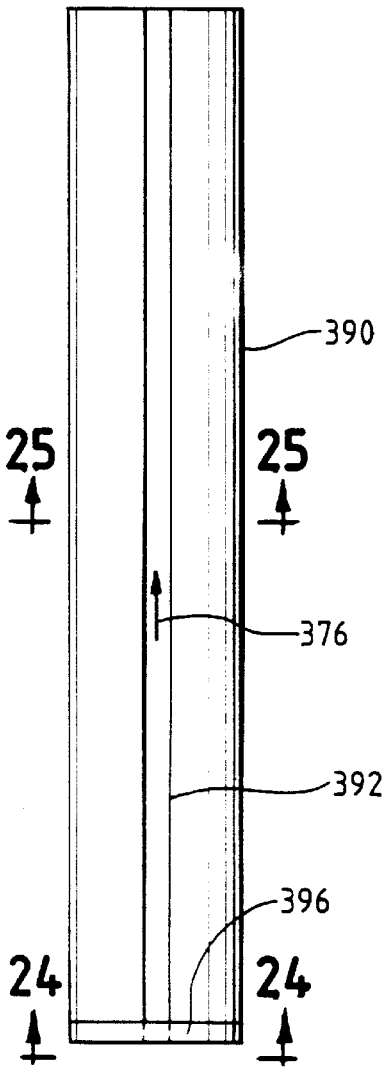
FIG. 23 is a top plan view of an alternate shear roller according to the present invention.
Figure 24:
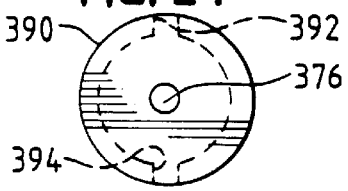
FIG. 24 is an elevation taken along line 24—24 of FIG. 23.
Figure 25:
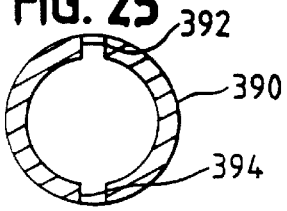
FIG. 25 is a section taken from section line 25—25 of FIG. 23.

FIGS. 23–25 show a shear member or roller 390 which is similar to the roller 370 of FIG. 21, except that it is hollow, with end caps, and has two channels 392 and 394 running generally axially. Alternatively, the roller 390 can be mounted parallel to the roller 64 and the channels 392 and 394 can have a slight helical pitch so fluid will run downhill from left to right. The channels 392 and 394 give the fluid expressed from the roller 32 by the shear roller 390 a space to go where the rollers are not squeezed together. The channels 392 and 394 can be blocked at one end by an end cap 396 and open at the other end so axially running fluid will exit the roll on the right end as shown in FIG. 21.

Figure 26:
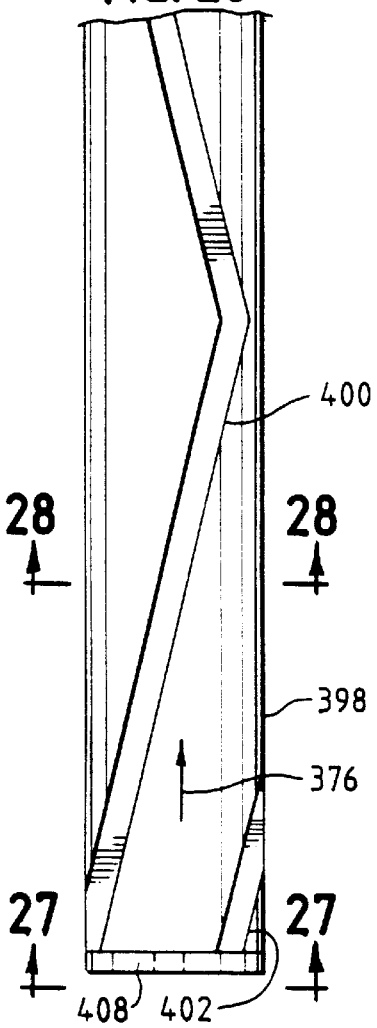
FIG. 26 is a top plan view of an alternate shear roller according to the present invention.
Figure 27:
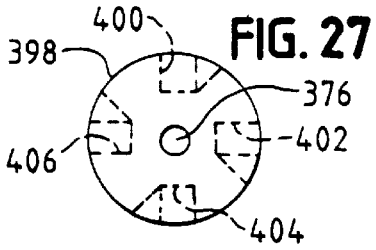
FIG. 27 is an elevation taken along line 27—27 of FIG. 23.
Figure 28:
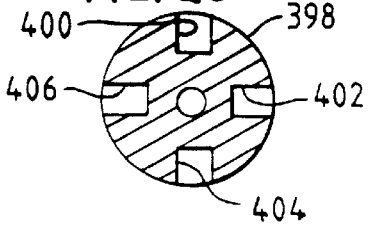
FIG. 28 is a section taken along line 28—28 of FIG. 26.

FIGS. 26–28 show a shear member or roller 398 which is similar to the roller 390 of FIGS. 23–25, except that it has four chevron-shaped channels 400, 402, 404, 406 and an end cap 408, similarly arranged. Each chevron shaped channel, such as the channel 406, is higher in the middle than at its ends when it confronts the roller 32, so fluid runs generally axially along the channel toward its ends.

Figure 29:
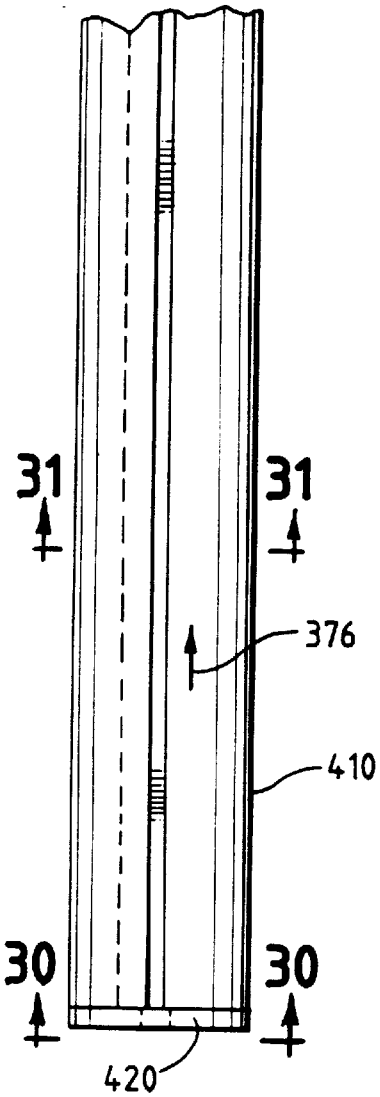
FIG. 29 is a top plan view of an alternate shear roller according to the present invention.
Figure 30:
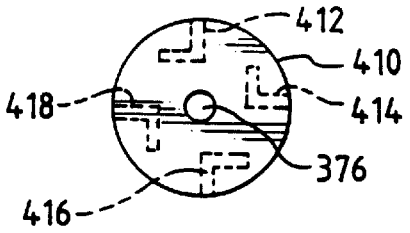
FIG. 30 is an elevation taken from line 30—30 of FIG. 29.
Figure 31:
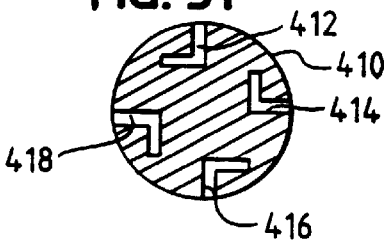
FIG. 31 is a section taken along section line 31—31 of FIG. 29.
Figure 32:
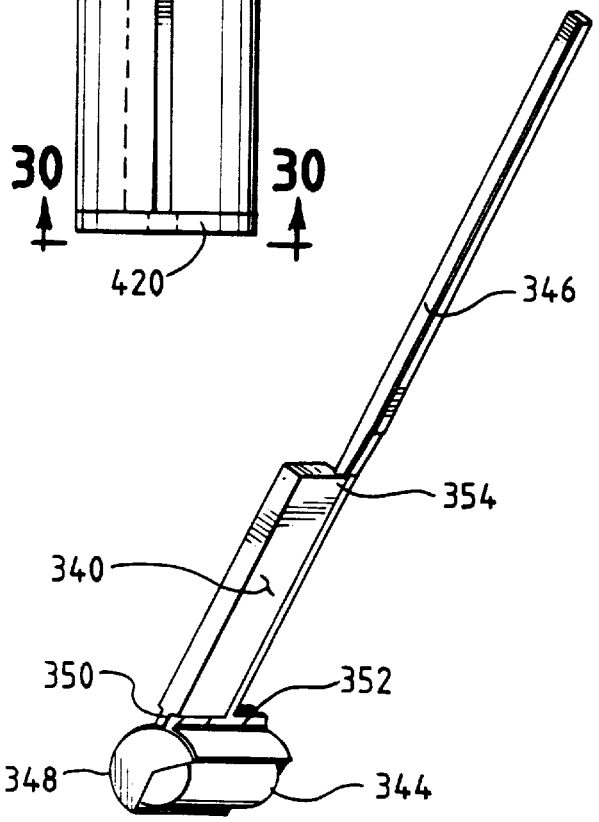
FIG. 32 is a schematic perspective view of a variation of the embodiment of FIG. 7, showing the implement with one of its two tanks installed on the implement.
Figure 33:
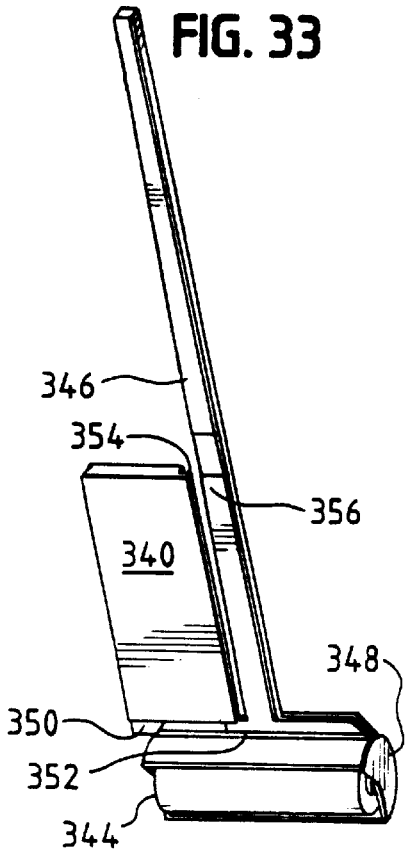
FIG. 33 is a schematic perspective view of a variation of the embodiment of FIG. 7, showing the implement with one of its two tanks partially installed on the implement.

FIGS. 29–31 show a shear member or roller 410 which is similar to the roller 390 of FIG. 23, except that it has four L-section channels 412, 414, 416, 418 and an end cap 420, similarly arranged. The channels 412–418 trap fluid received through the side of the roll 410 when rotating from the position of the channel 414 to the position of the channel 418, giving the fluid time to move axially toward the end(s) of the roll 410 where the staging area 388 can be located.

In the embodiments of FIGS. 16–31, the staging area 388 can be very small, as only enough fluid must be collected to cause the pump 38 to pump it as previously described. These embodiments also allow the roller 370 and the surface 64 to engage with relative rotation, thus minimizing friction when they are in contact.

Thus, a relatively simple hard surface care implement or system has been described which can be both inexpensive enough and light enough to meet the needs of residential customers, as well as commercial customers. An implement has been described which can be picked up and manipulated much as a mop or broom is used, while providing many advantageous features found in more expensive, larger, and typically heavier machines.

An improved system for scrubbing, mopping, light solids pick-up, stripping, and waxing bare (non-carpeted) floor surfaces is thus provided.

I claim:

1. A device for cleaning hard surfaces, the device comprising:

A. a moving absorbent surface having a first portion adapted to be normally disposed substantially in contact with a hard surface to define an area of contact and a second portion adapted to be normally disposed out of contact with the hard surface;

B. a shear member shiftable between a first position at least substantially contacting said second portion for removing fluid absorbed in said absorbent surface and a second position at least substantially clear of said absorbent surface for allowing absorbed fluid to remain in said absorbent surface;

C. a mechanism for moving said absorbent surface in a direction and at a velocity sufficient to move said absorbent surface relative to the hard surface at said area of contact as said device is being used; and D. a pump for transporting away the fluid removed by said shear member.

2. A device for cleaning hard surfaces, the device comprising:

A. a moving absorbent surface having a first portion adapted to be normally disposed substantially in contact with a hard surface to define an area of contact and a second portion adapted to be normally disposed out of contact with the hard surface;

B. a shear member shiftable between a first position at least substantially contacting said second portion for removing fluid absorbed in said absorbent surface and a second position at least substantially clear of said absorbent surface for allowing absorbed fluid to remain in said absorbent surface;

C. a mechanism for moving said absorbent surface in a direction and at a velocity sufficient to move said absorbent surface relative to the hard surface at said area of contact as said device is being used;

D. a handle having a distal portion adapted for use by an operator to control the device and a proximal portion operatively attached to said roller to allow rotation of said roller relative to said handle; and E. a shear member control mounted on the distal portion of said handle for moving said shear member between its first and second positions.

* * * * *